US008276892B2

(12) United States Patent
Narikawa et al.

(10) Patent No.: US 8,276,892 B2
(45) Date of Patent: Oct. 2, 2012

(54) HUMIDITY CONTROLLER

(75) Inventors: Yoshinori Narikawa, Osaka (JP); Shuji Ikegami, Osaka (JP); Nobuki Matsui, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 314 days.

(21) Appl. No.: 12/664,290

(22) PCT Filed: Jun. 3, 2008

(86) PCT No.: PCT/JP2008/001404

§ 371 (c)(1),
(2), (4) Date: Dec. 11, 2009

(87) PCT Pub. No.: WO2008/152780

PCT Pub. Date: Dec. 18, 2008

(65) Prior Publication Data

US 2010/0181690 A1 Jul. 22, 2010

(30) Foreign Application Priority Data

Jun. 12, 2007 (JP) ..... 2007-155207
Oct. 31, 2007 (JP) ..... 2007-283996

(51) Int. Cl.
*B01F 3/04* (2006.01)

(52) U.S. Cl. ..... 261/131; 62/271; 236/44 A

(58) Field of Classification Search ..... 261/129, 261/131, DIG. 15; 62/160, 271, 476; 236/44 A
See application file for complete search history.

(56) References Cited

U.S. PATENT DOCUMENTS 4,952,283 A * 8/1990 Besik ..... 165/4
5,887,784 A * 3/1999 Haas ..... 236/44 A
7,096,684 B2 * 8/2006 Yabu et al. ..... 62/271
7,412,836 B2 * 8/2008 Ikegami et al. ..... 62/94
7,472,553 B2 * 1/2009 Ikegami et al. ..... 62/94

(Continued)

FOREIGN PATENT DOCUMENTS

JP 2005-291532 A 10/2005
JP 2006-23079 A 1/2006
JP 2006-78108 A 3/2006
JP 2006-349304 A 12/2006

*Primary Examiner* — Charles Bushey
(74) *Attorney, Agent, or Firm* — Birch, Stewart, Kolasch & Birch, LLP.

(57) ABSTRACT

According to a humidity controller (10), a first heat exchanger chamber (37) and a second heat exchanger chamber (38) are arranged next to each other in the left-to-right direction in the casing (11). A first adsorption heat exchanger (51) is accommodated in the first heat exchanger chamber (37), and a second adsorption heat exchanger (52) is accommodated in the second heat exchanger chamber (38). The humidity controller (10) alternately performs an operation in which outdoor air passes through the first adsorption heat exchanger (51) and room air passes through the second adsorption heat exchanger (52), and an operation in which outdoor air passes through the second adsorption heat exchanger (52) and room air passes through the first adsorption heat exchanger (51). In the humidity controller (10), dampers (45, 47) which face the first heat exchanger chamber (37) near a supply fan (26), are positioned at locations close to the second heat exchanger chamber (38), and dampers (46, 48) which face the second heat exchanger chamber (38) near an exhaust fan (25), are positioned at locations close to the first heat exchanger chamber (37). This structure reduces a difference between pressure losses of the air in the casing (11) during the respective operations.

1 Claim, 13 Drawing Sheets

U.S. PATENT DOCUMENTS 7,895,856 B2 * 3/2011 Narikawa et al. ..... 62/271
7,984,619 B2 * 7/2011 Matsui ..... 62/271
8,006,509 B2 * 8/2011 Matsui et al. ..... 62/271
8,047,014 B2 * 11/2011 Yabu et al. ..... 62/324.5
2006/0196195 A1 * 9/2006 Ikegami et al. ..... 62/94
2007/0214810 A1 * 9/2007 Yabu et al. ..... 62/93

* cited by examiner

Second Operation

First Operation

HUMIDITY CONTROLLER

TECHNICAL FIELD

The present invention relates to a humidity controller which controls humidity of air using an adsorbent.

BACKGROUND ART

Humidity controllers which controls humidity using an adsorbent have been known. Patent Document 1 discloses a humidity controller which includes an adsorption heat exchanger carrying an adsorbent on its surface.

The humidity controller described in Patent Document 1 is provided with a refrigerant circuit which includes two adsorption heat exchangers. The refrigerant circuit alternately performs an operation in which the first adsorption heat exchanger serves as a condenser and the second adsorption heat exchanger serves as an evaporator, and an operation in which the second adsorption heat exchanger serves as a condenser and the first adsorption heat exchanger serves as an evaporator. In the adsorption heat exchanger serving as an evaporator, moisture in the air is adsorbed by the adsorbent. In the adsorption heat exchanger serving as a condenser, the moisture is desorbed from the adsorbent and is released in the air.

According to the humidity controller described in Patent Document 1, one of the air currents which have passed through the adsorption heat exchangers is supplied into a room and the other air current is exhausted to the outside. For example, in the humidity controller during the dehumidification operation, the flow path of the air in the casing is formed such that the air which has passed through one of the first and second adsorption heat exchangers that serves as an evaporator is supplied into a room, and the air which has passed through the adsorption heat exchanger that serves as a condenser is exhausted to the outside (see FIG. 5 and FIG. 6 in Patent Document 1).

Further, the humidity controller described in Patent Document 1 ventilates a room. The humidity controller during the dehumidification operation dehumidifies the outdoor air taken therein, using the adsorption heat exchanger serving as an evaporator, and supplies the dehumidified air into a room, and exhausts the room air taken therein to the outside together with moisture desorbed from the adsorption heat exchanger serving as a condenser. On the other hand, the humidity controller during the humidification operation humidifies the outdoor air taken therein, using the adsorption heat exchanger serving as a condenser, and supplies the humidified air into a room, and dehumidifies the room air taken therein, using the adsorption heat exchanger serving as an evaporator, and exhausts the dehumidified room air to the outside.

CITATION LIST

Patent Document

PATENT DOCUMENT 1: Japanese Patent Publication No. 2006-078108

SUMMARY OF THE INVENTION

Technical Problem

As mentioned in the above, according to the humidity controller disclosed in Patent Document 1, a flow path of the air in the casing is varied between the operation in which the first adsorption heat exchanger serves as a condenser and the second adsorption heat exchanger serves as an evaporator, and the operation in which the second adsorption heat exchanger serves as a condenser and the first adsorption heat exchanger serves as an evaporator. If a pressure loss at a time when the air flows through the casing is significantly changed according to the flow path of the air, the amount of air supplied to a room and the amount of air exhausted to the outside are changed every time the flow path of the air in the casing is changed. As a result, it is difficult to maintain a constant condition of the air in the room.

The present invention was made in view of the above problem, and its object is to reduce, in a humidity controller in which a flow path of the air in the casing is changed during its operation, a difference between pressure losses of the air in the respective flow paths of the air, and thereby preventing changes in the amount of air supplied into a room and the amount of air exhausted to the outside.

Solution to the Problem

The first aspect of the present invention is a humidity controller including: a heat transfer circuit (50) to which first and second adsorption heat exchangers (51, 52) each carrying an adsorbent are connected and through which a heat transfer fluid flows; and a casing (11) in which the first and second adsorption heat exchangers (51, 52) are accommodated, wherein an operation in which the adsorbent of the first adsorption heat exchanger (51) is cooled and the adsorbent of the second adsorption heat exchanger (52) is heated, and an operation in which the adsorbent of the second adsorption heat exchanger (52) is cooled and the adsorbent of the first adsorption heat exchanger (51) is heated are alternately performed, and one of an air current which has passed through the first adsorption heat exchanger (51) and an air current which has passed through the second adsorption heat exchanger (52) is supplied to a room, and the other air current is exhausted to the outside. In the casing (11), a first main air passage (37) in which the first adsorption heat exchanger (51) is located and a second main air passage (38) in which the second adsorption heat exchanger (52) is located are arranged next to each other; a supply side passage (31) which communicates with the room, and an exhaust side passage (33) which communicates with the outside are arranged next to each other; and each of the supply side passage (31) and the exhaust side passage (33) is adjacent to both of the first and second main air passages (37, 38); and the casing (11) has a supply opening (22) which communicates with the supply side passage (31) and which is positioned at a location close to the first main air passage (37), and an exhaust opening (21) which communicates with the exhaust side passage (33) and which is positioned at a location close to the second main air passage (38); and a partition plate (72) by which the first and second main air passages (37, 38), and the supply side passage (31) and the exhaust side passage (33) are separated, is provided with a first supply side damper (45) by which the first main air passage (37) and the supply side passage (31) are connected to/disconnected from each other and a first exhaust side damper (47) by which the first main air passage (37) and the exhaust side passage (33) are connected to/disconnected from each other, at locations close to the second main air passage (38), and is provided with a second supply side damper (46) by which the second main air passage (38) and the supply side passage (31) are connected to/disconnected from each other and a second exhaust side damper (48) by which the second main air passage (38) and the exhaust side passage (33) are connected to/disconnected from each other, at locations close to the first main air passage (37).

According to the first aspect of the present invention, the humidity controller (10) alternately performs two operations. During the operation in which the adsorbent of the first adsorption heat exchanger (51) is cooled and the adsorbent of the second adsorption heat exchanger (52) is heated, a heat transfer fluid for cooling is supplied to the first adsorption heat exchanger (51) and a heat transfer fluid for heating is supplied to the second adsorption heat exchanger (52). During this operation, the air flowing in the first main air passage (37) is dehumidified when it passes through the first adsorption heat exchanger (51), and the air flowing in the second main air passage (38) is humidified when it passes through the second adsorption heat exchanger (52). During the operation in which the adsorbent of the second adsorption heat exchanger (52) is cooled and the adsorbent of the first adsorption heat exchanger (51) is heated, a heat transfer fluid for cooling is supplied to the second adsorption heat exchanger (52) and a heat transfer fluid for heating is supplied to the first adsorption heat exchanger (51). During this operation, the air flowing in the first main air passage (37) is humidified when it passes through the first adsorption heat exchanger (51), and the air flowing in the second main air passage (38) is dehumidified when it passes through the second adsorption heat exchanger (52).

In the humidity controller (10) according to the first aspect of the present invention, one of dehumidified air and humidified air is supplied into a room, and the other is exhausted to the outside. In this humidity controller (10), the first supply side damper (45) and the second supply side damper (46) are alternately opened and closed such that one of the first supply side damper (45) and the second supply side damper (46) is open when the other is closed. Further, in the humidity controller (10), the first exhaust side damper (47) and the second exhaust side damper (48) are alternately opened and closed such that one of the first exhaust side damper (47) and the second exhaust side damper (48) is open when the other is closed. In the humidity controller (10), the state in which the first main air passage (37) communicates with the supply side passage (31) and the second main air passage (38) communicates with the exhaust side passage (33), and the state in which the second main air passage (38) communicates with the supply side passage (31) and the first main air passage (37) communicates with the exhaust side passage (33), are alternately repeated.

In the humidity controller (10) according to the first aspect of the present invention, the air having flowed into the supply side passage (31) is supplied into a room through the supply opening (22). In this humidity controller (10), the state in which the air flows into the supply side passage (31) through the first supply side damper (45), and the state in which the air flows into the supply side passage (31) through the second supply side damper (46), are alternately repeated. In this humidity controller (10), the first supply side damper (45) for opening and closing the first main air passage (37) near the supply opening (22) is positioned at a location close to the second main air passage (38) remote from the supply opening (22). The second supply side damper (46) for opening and closing the second main air passage (38) remote from the supply opening (22) is positioned at a location close to the first main air passage (37) near the supply opening (22).

In the humidity controller (10) according to the first aspect of the present invention, the air having flowed into the exhaust side passage (33) is exhausted to the outside through the exhaust opening (21). In this humidity controller (10), the state in which the air flows into the exhaust side passage (33) through the first exhaust side damper (47), and the state in which the air flows into the exhaust side passage (33) through the second exhaust side damper (48), are alternately repeated. In this humidity controller (10), the first supply side damper (45) for opening and closing the first main air passage (37) remote from the exhaust opening (21) is positioned at a location close to the second main air passage (38) near the exhaust opening (21). The second supply side damper (46) for opening and closing the second main air passage (38) near the exhaust opening (21) is positioned at a location close to the first main air passage (37) remote from the exhaust opening (21).

The second aspect of the present invention according to the first aspect of the present invention is that in the casing (11), an indoor air side passage (32) into which air flows from the room and an outdoor air side passage (34) into which air flows from the outside are arranged next to each other on an opposite side of the supply side passage (31) and the exhaust side passage (33) with respect to the first and second main air passages (37, 38), and each of the indoor air side passage (32) and the outdoor air side passage (34) is adjacent to the first and second main air passages (37, 38); the casing (11) has an indoor air intake opening (23) which communicates with the indoor air side passage (32) and which is positioned at a location close to the first main air passage (37), and an outdoor air intake opening (24) which communicates with the outdoor air side passage (34) and which is positioned at a location close to the second main air passage (38); and a partition plate (71) by which the first and second main air passages (37, 38), and the indoor air side passage (32) and the outdoor air side passage (34) are separated, is provided with a first indoor air side damper (41) by which the first main air passage (37) and the indoor air side passage (32) are connected to/disconnected from each other and a first outdoor air side damper (43) by which the first main air passage (37) and the outdoor air side passage (34) are connected to/disconnected from each other, at locations close to the second main air passage (38), and is provided with a second indoor air side damper (42) by which the second main air passage (38) and the indoor air side passage (32) are connected to/disconnected from each other and a second outdoor air side damper (44) by which the second main air passage (38) and the outdoor air side passage (34) are connected to/disconnected from each other, at locations close to the first main air passage (37).

In the humidity controller (10) according to the second aspect of the present invention, air flows into the indoor air side passage (32) from a room through the indoor air intake opening (23). In this humidity controller (10), the state in which the air flows into the first main air passage (37) from the indoor air side passage (32) through the first indoor air side damper (41), and the state in which the air flows into the second main air passage (38) from the indoor air side passage (32) through the second indoor air side damper (42), are alternately repeated. In this humidity controller (10), the first indoor air side damper (41) for opening and closing the first main air passage (37) near the indoor air intake opening (23) is positioned at a location close to the second main air passage (38) remote from the indoor air intake opening (23). The second indoor air side damper (42) for opening and closing the second main air passage (38) remote from the indoor air intake opening (23) is positioned at a location close to the first main air passage (37) near the indoor air intake opening (23).

In the humidity controller (10) according to the second aspect of the present invention, air flows into the outdoor air side passage (34) from the outside through the outdoor air intake opening (24). In this humidity controller (10), the state in which the air flows into the first main air passage (37) from the outdoor air side passage (34) through the first outdoor air side damper (43), and the state in which the air flows into the second main air passage (38) from the outdoor air side passage (34) through the second outdoor air side damper (44), are alternately repeated. In this humidity controller (10), the first outdoor air side damper (43) for opening and closing the first main air passage (37) remote from the outdoor air intake opening (24) is positioned at a location close to the second main air passage (38) near the outdoor air intake opening (24). The second outdoor air side damper (44) for opening and closing the second main air passage (38) near the outdoor air intake opening (24) is positioned at a location close to the first main air passage (37) remote from the outdoor air intake opening (24).

The humidity controller (10) according to the second aspect of the present invention may perform an operation in which humidity of the outdoor air taken in the humidity controller (10) is controlled and then supplied into a room. In the humidity controller (10) during this operation, the outdoor air flows into one of the main air passages (37, 38) from the outdoor air side passage (34), passes through the adsorption heat exchangers (51, 52), and then passes through the supply side passage (31) and the supply opening (22) in this order to be supplied into a room. In the humidity controller (10) during this operation, the room air flows into one of the main air passages (37, 38) from the indoor air side passage (32), passes through the adsorption heat exchangers (51, 52), and then passes through the exhaust side passage (33) and the exhaust opening (21) in this order to be exhausted to the outside.

The third aspect of the present invention according to the second aspect of the present invention is that in the casing (11), the indoor air intake opening (23) is positioned at a location that faces the first indoor air side damper (41), and the outdoor air intake opening (24) is positioned at a location that faces the second outdoor air side damper (44).

In the third aspect of the present invention, the indoor air intake opening (23) is positioned at a location that faces the first indoor air side damper (41). That is, the indoor air intake opening (23) is positioned at a location adjacent to the first indoor air side damper (41). The second indoor air side damper (42) is positioned at a location close to the first main air passage (37). Thus, although the distance between the indoor air intake opening (23) and the second indoor air side damper (42) is greater than the distance between the indoor air intake opening (23) and the first indoor air side damper (41), the absolute distance between the indoor air intake opening (23) and the second indoor air side damper (42) is relatively short.

In the third aspect of the present invention, the outdoor air intake opening (24) is positioned at a location that faces the second outdoor air side damper (44). That is, the outdoor air intake opening (24) is positioned at a location adjacent to the second outdoor air side damper (44). The first outdoor air side damper (43) is positioned at a location close to the second main air passage (38). Thus, although the distance between the outdoor air intake opening (24) and the first outdoor air side damper (43) is greater than the distance between the outdoor air intake opening (24) and the second outdoor air side damper (44), the absolute distance between the outdoor air intake opening (24) and the first outdoor air side damper (43) is relatively short.

Advantages of the Invention

In the humidity controller (10) of the present invention, the supply opening (22) is positioned at a location close to the first main air passage (37) in the casing (11). In the humidity controller (10), the first supply side damper (45) for opening and closing the first main air passage (37) near the supply opening (22) is positioned at a location close to the second main air passage (38) remote from the supply opening (22). The second supply side damper (46) for opening and closing the second main air passage (38) remote from the supply opening (22) is positioned at a location close to the first main air passage (37) near the supply opening (22). Therefore, according to the present invention, a pressure loss of the air flowing from the first main air passage (37) through the first supply side damper (45) to the supply opening (22), and a pressure loss of the air flowing from the second main air passage (38) through the second supply side damper (46) to the supply opening (22), can be equalized.

In the humidity controller (10) according to the present invention, the exhaust opening (21) is positioned at a location close to the second main air passage (38) in the casing (11). In the humidity controller (10), the first exhaust side damper (47) for opening and closing the first main air passage (37) remote from the exhaust opening (21) is positioned at a location close to the second main air passage (38) near the exhaust opening (21). The second exhaust side damper (48) for opening and closing the second main air passage (38) near the exhaust opening (21) is positioned at a location close to the first main air passage (37) remote from the exhaust opening (21). Therefore, according to the present invention, a pressure loss of the air flowing from the first main air passage (37) through the first exhaust side damper (47) to the exhaust opening (21), and a pressure loss of the air flowing from the second main air passage (38) through the second exhaust side damper (48) to the exhaust opening (21), can be equalized.

Further, in the humidity controller (10) according to the second aspect of the present invention, the indoor air intake opening (23) is positioned at a location close to the first main air passage (37) in the casing (11). In the humidity controller (10), the first indoor air side damper (41) for opening and closing the first main air passage (37) near the indoor air intake opening (23) is positioned at a location close to the second main air passage (38) remote from the indoor air intake opening (23). The second indoor air side damper (42) for opening and closing the second main air passage (38) remote from the indoor air intake opening (23) is positioned at a location close to the first main air passage (37) near the indoor air intake opening (23). Therefore, according to the present invention, the difference between a pressure loss of the air flowing from the indoor air intake opening (23) through the first indoor air side damper (41) to the first main air passage (37), and a pressure loss of the air flowing from the indoor air intake opening (23) through the second indoor air side damper (42) to the second main air passage (38), can be reduced.

In the humidity controller (10) according to the second aspect of the present invention, the outdoor air intake opening (24) is positioned at a location close to the second main air passage (38) in the casing (11). In the humidity controller (10), the first outdoor air side damper (43) for opening and closing the first main air passage (37) remote from the outdoor air intake opening (24) is positioned at a location close to the second main air passage (38) near the outdoor air intake opening (24). The second outdoor air side damper (44) for opening and closing the second main air passage (38) near the outdoor air intake opening (24) is positioned at a location close to the first main air passage (37) remote from the outdoor air intake opening (24). Therefore, according to the present invention, the difference between a pressure loss of the air flowing from the outdoor air intake opening (24)

through the first outdoor air side damper (43) to the first main air passage (37), and a pressure loss of the air flowing from the outdoor air intake opening (24) through the second outdoor air side damper (44) to the second main air passage (38), can be reduced.

Further, according to the third aspect of the present invention, the distance between the indoor air intake opening (23) and the second indoor air side damper (42) is greater than the distance between the indoor air intake opening (23) and the first indoor air side damper (41), but the absolute distance between the indoor air intake opening (23) and the second indoor air side damper (42) is relatively short. Therefore, according to the present invention, the difference between a pressure loss of the air flowing from the indoor air intake opening (23) through the first indoor air side damper (41) to the first main air passage (37), and a pressure loss of the air flowing from the indoor air intake opening (23) through the second indoor air side damper (42) to the second main air passage (38), can be reduced.

Moreover, according to the third aspect of the present invention, the distance between the outdoor air intake opening (24) and the first outdoor air side damper (43) is greater than the outdoor air intake opening (24) and the second outdoor air side damper (44), but the absolute distance between the outdoor air intake opening (24) and the first outdoor air side damper (43) is relatively short. Therefore, according to the present invention, the difference between a pressure loss of the air flowing from the outdoor air intake opening (24) through the first outdoor air side damper (43) to the first main air passage (37), and a pressure loss of the air flowing from the outdoor air intake opening (24) through the second outdoor air side damper (44) to the second main air passage (38), can be reduced.

BRIEF DESCRIPTION OF THE DRAWINGS

FIG. 7 illustrates a pipe system showing a structure of the refrigerant circuit.

DESCRIPTION OF EMBODIMENTS

Figure 1:
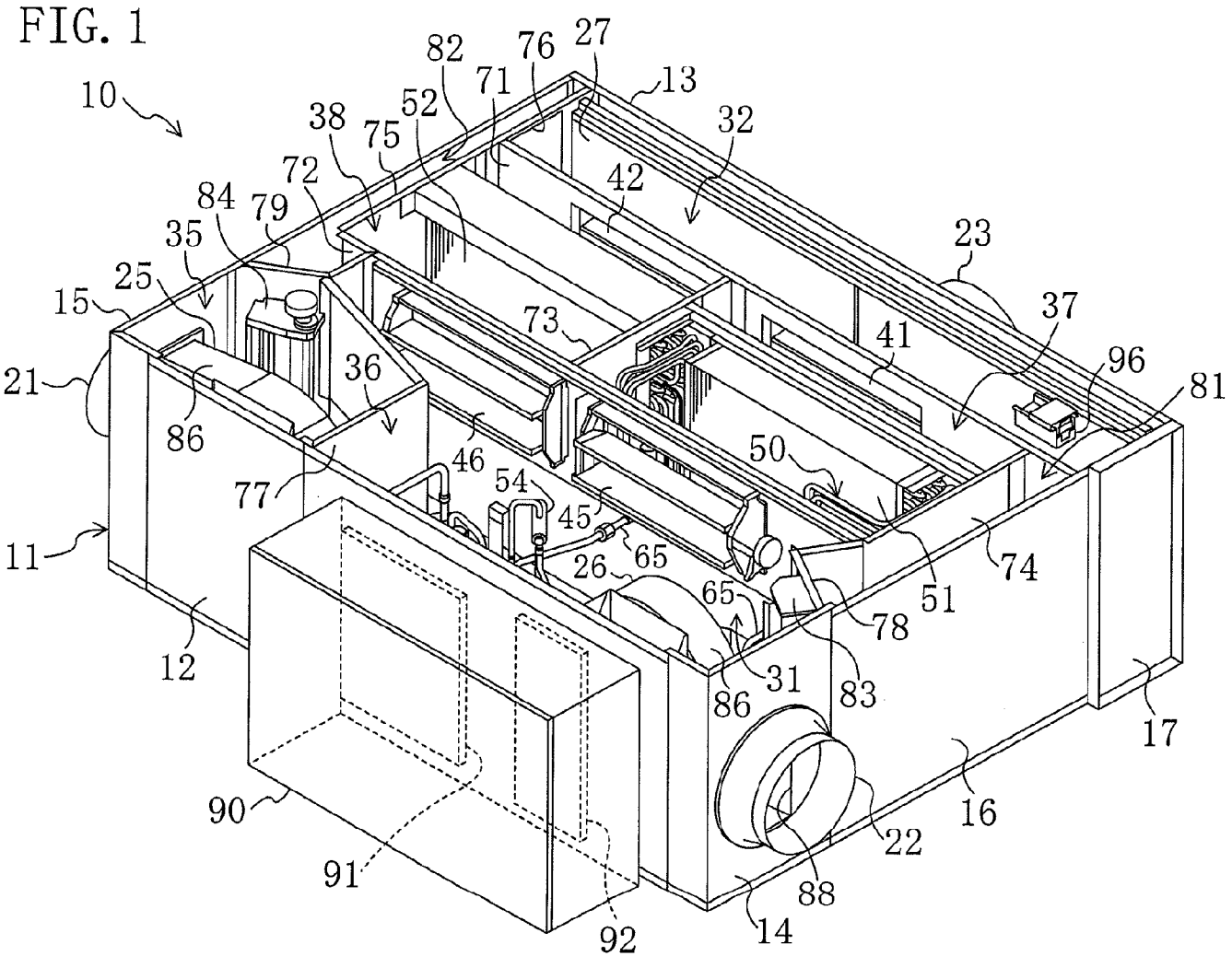
FIG. 1 shows an oblique view of a humidity controller from the front side thereof without a top plate of a casing.

An embodiment of the present invention will be described in detail below based on the drawings. A humidity controller (10) of the present embodiment controls the humidity of a room and ventilates the room. The humidity controller (10) controls the humidity of outdoor air (OA) taken therein and supplies the controlled air into a room, and exhausts room air (RA) taken therein to the outside.

<General Structure of Humidity Controller>

The humidity controller (10) will be described with reference to FIGS. 1-6. The terms "upper," "lower," "left," "right," "front," "rear," "on the front of and "behind" used in the following description indicate the directions as seen from the front side of the humidity controller (10), unless otherwise specified.

The humidity controller (10) has a casing (11). The casing (11) accommodates a refrigerant circuit (50). A first adsorption heat exchanger (51), a second adsorption heat exchanger (52), a compressor (53), a four-way selector valve (54), and an electrically-operated expansion valve (55) are connected to the refrigerant circuit (50). The details of the refrigerant circuit (50) will be described later.

The casing (11) is formed in a flattish, relatively small-height, rectangular parallelepiped shape. The dimension of the casing (11) in the left-to-right direction is slightly greater than the dimension of the casing (11) in the front-to-rear direction (see FIG. 3). In the casing (11), a side face at the lower left portion of FIG. 1 (i.e., the front surface) is a front panel portion (12), and a side face at the upper right portion of FIG. 1 (i.e., the rear surface) is a rear panel portion (13). In the casing (11), a side face at the lower right portion of FIG. 1 is a first side panel portion (14), and a side face at the upper left portion of FIG. 1 is a second side panel portion (15).

In the casing (11), the front panel portion (12) and the rear panel portion (13) face each other, and the first side panel portion (14) and the second side panel portion (15) face each other. In this casing (11), the first side panel portion (14) and the second side panel portion (15) constitute side plate portions.

The casing (11) is provided with an outdoor air intake opening (24), an indoor air intake opening (23), a supply opening (22), and an exhaust opening (21).

Figure 3:
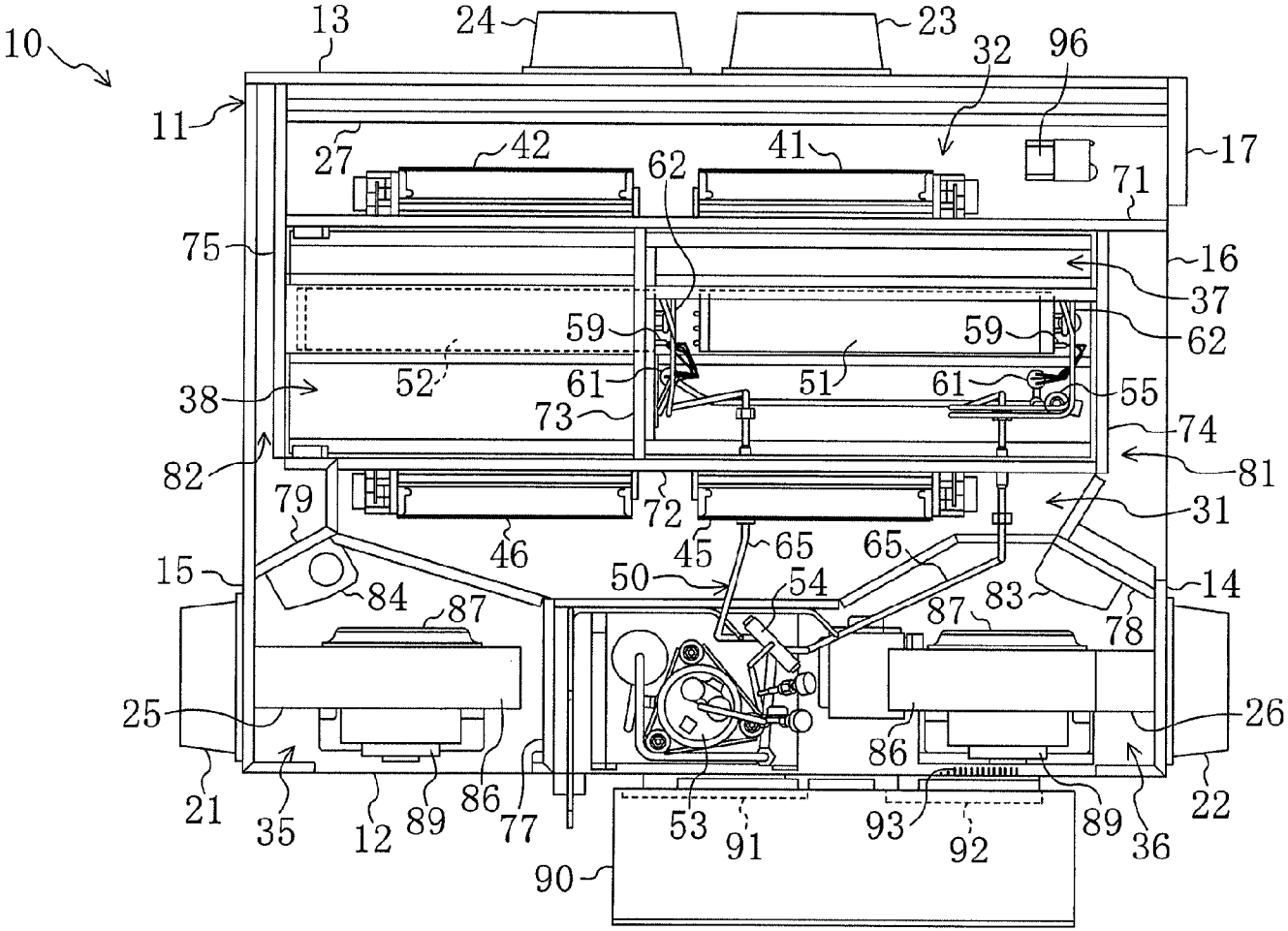
FIG. 3 shows a top view of the humidity controller without the top plate of the casing.
Figure 5:
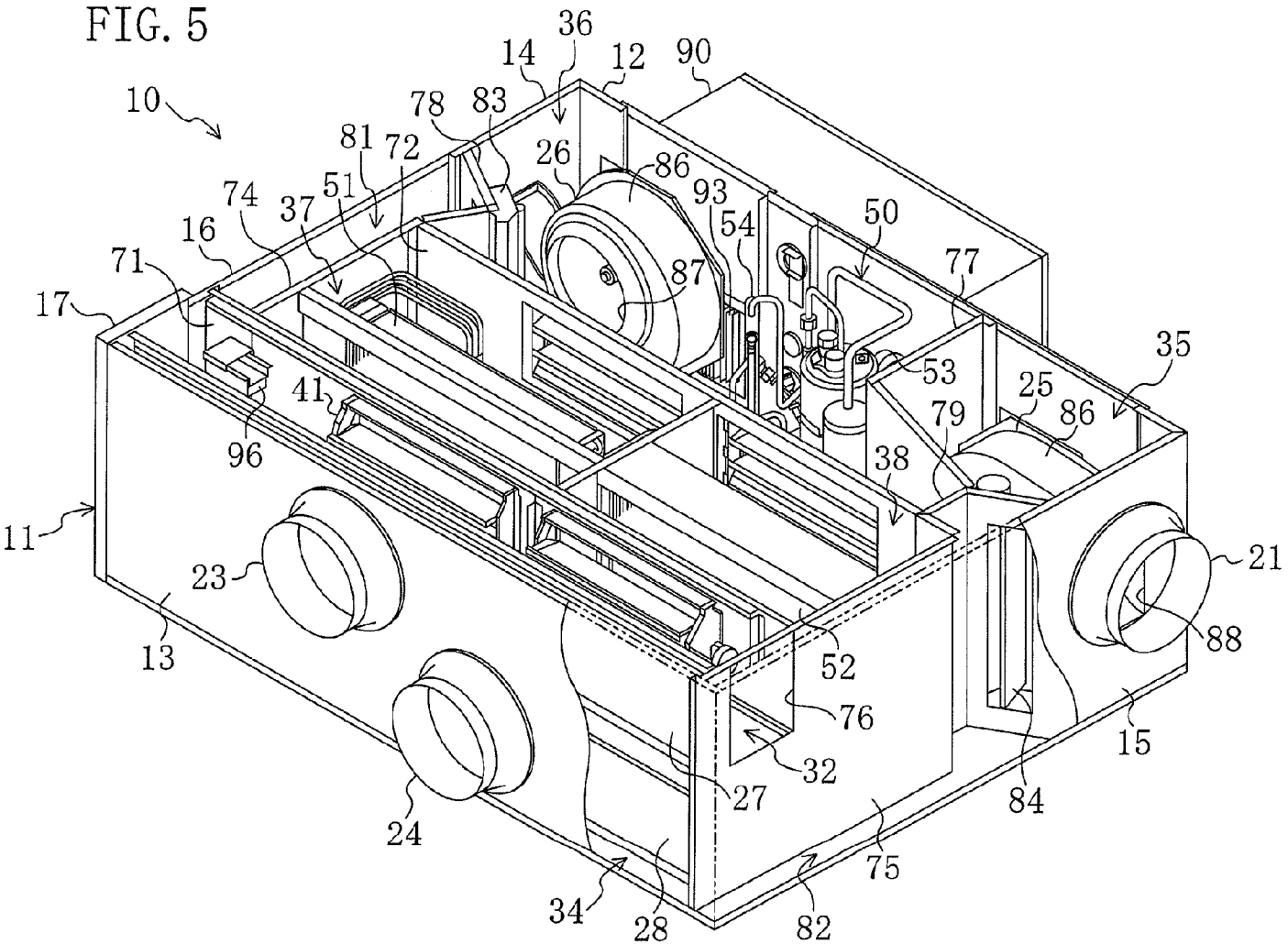
FIG. 5 shows an oblique view of the humidity controller from the rear surface side thereof without the top plate of the casing.

The outdoor air intake opening (24) and the indoor air intake opening (23) are formed in the rear panel portion (13) (see FIG. 3 and FIG. 5). The outdoor air intake opening (24) is located at a lower portion of the rear panel portion (13). The outdoor air intake opening (24) is offset from the center of the rear panel portion (13) in the left-to-right direction to the second side panel portion (15) side. The indoor air intake opening (23) is located at an upper portion of the rear panel portion (13). The indoor air intake opening (23) is offset from the center of the rear panel portion (13) in the left-to-right direction to the first side panel portion (14) side. That is, the rear panel portion (13) is provided with the outdoor air intake opening (24) which is positioned closer to the second heat exchanger chamber (38), described later, than the center of the rear panel portion (13) in the left-to-right direction, and the indoor air intake opening (23) which is positioned closer to the first heat exchanger chamber (37), described later, than the center of the rear panel portion (13) in the left-to-right direction.

The supply opening (22) is located at a portion of the first side panel portion (14) that is close to the end of the first side panel portion (14) on the front panel portion (12) side. The exhaust opening (21) is located at a portion of the second side panel portion (15) that is close to the end of the second side panel portion (15) on the front panel portion (12) side. That is, the casing (11) is provided with the exhaust opening (21) which is positioned closer to the second heat exchanger chamber (38), described later, than the center of the casing (11) in the left-to-right direction, and the supply opening (22) which is positioned closer to the first heat exchanger chamber (37), described later, than the center of the casing (11) in the left-to-right direction.

An upstream side partition plate (71), a downstream side partition plate (72), a middle partition plate (73), a first partition plate (74), and a second partition plate (75) are provided in the interior space of the casing (11). All of these partition plates (71-75) stand on the bottom plate of the casing (11), and extend from the bottom plate to the top plate of the casing (11) to divide the interior space of the casing (11).

The upstream side partition plate (71) and the downstream side partition plate (72) are in parallel to the front panel portion (12) and the rear panel portion (13). In the interior space of the casing (11), the upstream side partition plate (71) is positioned at a location close to the rear panel portion (13), and the downstream side partition plate (72) is positioned at a location close to the front panel portion (12).

The dimension of the upstream side partition plate (71) in the left-to-right direction is smaller than the dimension of the casing (11) in the left-to-right direction. Most of the lower half of the right end portion of the upstream side partition plate (71) is cut off, and the upper half thereof is joined to the first side panel portion (14). A space is formed between the left end portion of the upstream side partition plate (71) and the second side panel portion (15). The upstream side partition plate (71) does not have to be composed of a single member. For example, the upstream side partition plate (71) may be composed of a member by which the indoor air side passage (32), described later, and the heat exchanger chambers (37, 38) are separated from each other, and a member by which the outdoor air side passage (34), described later, and the heat exchanger chambers (37, 38) are separated from each other.

The dimension of the downstream side partition plate (72) in the left-to-right direction is smaller than the dimension of the upstream side partition plate (71) in the left-to-right direction. A space is formed between the right end portion of the downstream side partition plate (72) and the first side panel portion (14). A space is also formed between the left end portion of the downstream side partition plate (72) and the second side panel portion (15). The downstream side partition plate (72) does not have to be composed of a single member. For example, the downstream side partition plate (72) may be composed of a member by which the supply side passage (31), described later, and the heat exchanger chambers (37, 38) are separated from each other, and a member by which the exhaust side passage (33), described later, and the heat exchanger chambers (37, 38) are separated from each other.

The first partition plate (74) is located such that it encloses the space between the upstream side partition plate (71) and the downstream side partition plate (72) from the right. Specifically, the first partition plate (74) is positioned to be in parallel with the first side panel portion (14) and to be orthogonal to the upstream side partition plate (71) and the downstream side partition plate (72). The front end portion of the first partition plate (74) is joined to the right end portion of the downstream side partition plate (72). The rear end portion of the first partition plate (74) is joined to the upstream side partition plate (71).

The second partition plate (75) is located such that it encloses the space between the upstream side partition plate (71) and the downstream side partition plate (72) from the left. Specifically, the second partition plate (75) is positioned to be in parallel with the second side panel portion (15) and to be orthogonal to the upstream side partition plate (71) and the downstream side partition plate (72). The front end portion of the second partition plate (75) is joined to the left end portion of the downstream side partition plate (72). The rear end portion of the second partition plate (75) is joined to the rear panel portion (13). The left end portion of the upstream side partition plate (71) is joined to the second partition plate (75).

The middle partition plate (73) is positioned between the upstream side partition plate (71) and the downstream side partition plate (72) so as to be orthogonal to the upstream side partition plate (71) and the downstream side partition plate (72). The middle partition plate (73) extends from the upstream side partition plate (71) to the downstream side partition plate (72) to divide the space between the upstream side partition plate (71) and the downstream side partition plate (72) into left and right spaces. The middle partition plate (73) is provided at a location slightly closer to the second side panel portion (15) than the centers of the upstream side partition plate (71) and the downstream side partition plate (72) in the left-to-right direction.

Figure 2:
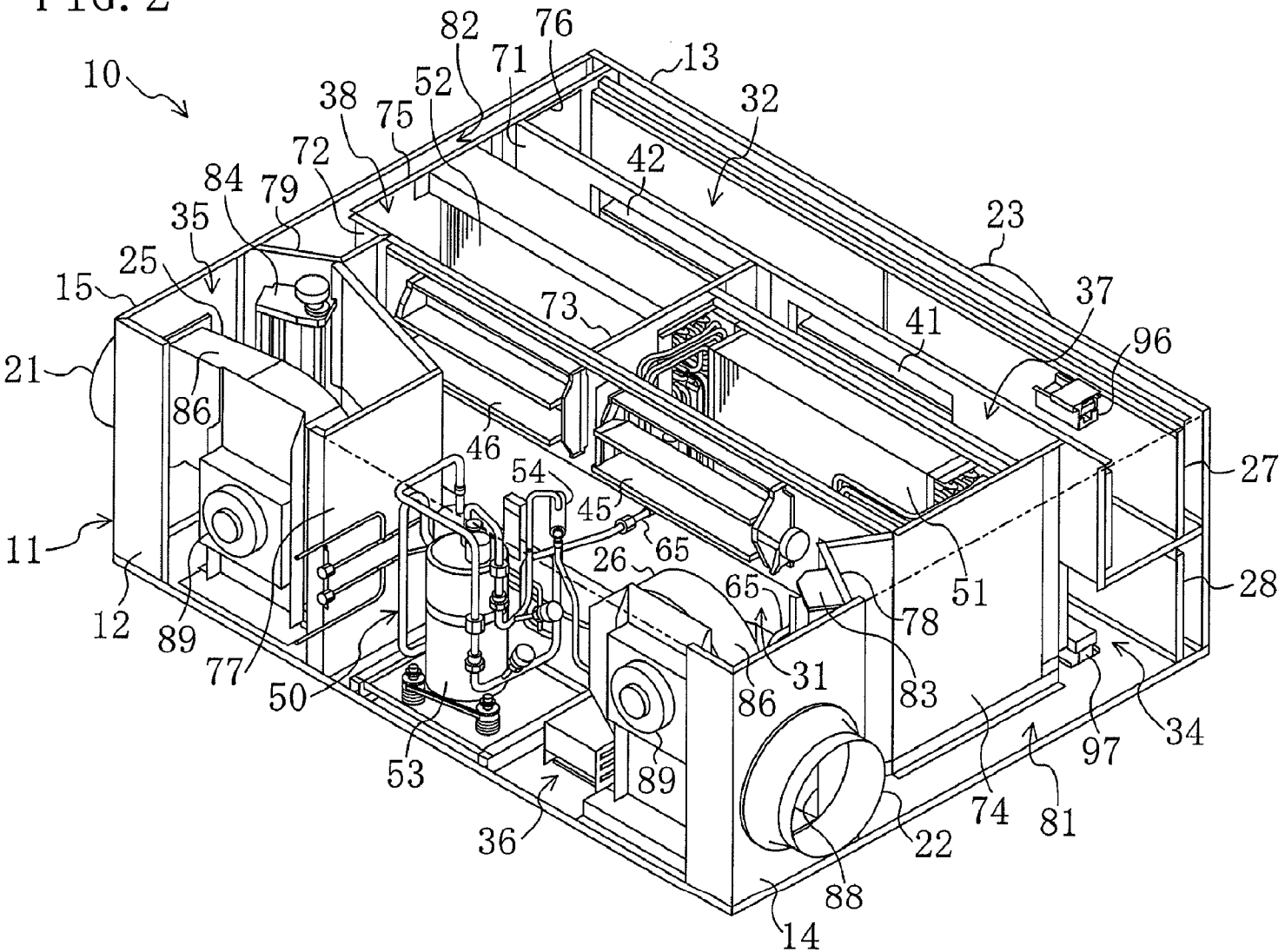
FIG. 2 shows an oblique view of the humidity controller from the front side thereof without part of the casing and a box for electrical components.
Figure 6:
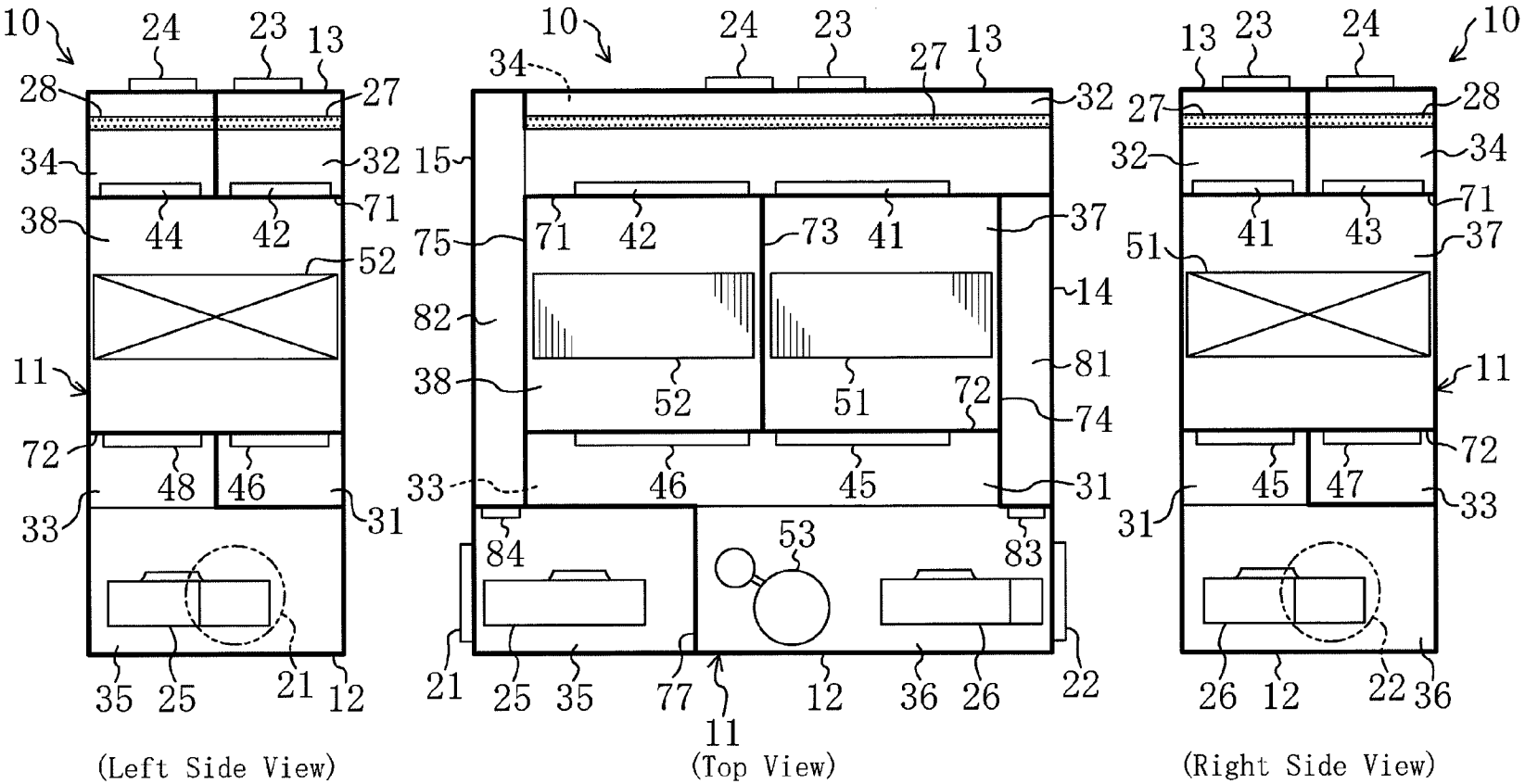
FIG. 6 shows schematic top, right side, and left side views of the humidity controller without part of the humidity controller.

In the casing (11), the space between the upstream side partition plate (71) and the rear panel portion (13) are divided into two spaces, i.e., upper and lower spaces (see FIG. 2, FIG. 5 and FIG. 6). The upper space constitutes an indoor air side passage (32), and the lower space constitutes an outdoor air side passage (34). The indoor air side passage (32) and the outdoor air side passage (34) constitute an intake side space through which air to be supplied into the adsorption heat exchangers (51, 52), described later, (i.e., air before passing through the adsorption heat exchangers (51, 52)) flows.

The indoor air side passage (32) communicates with a room through a duct connected to the indoor air intake opening (23). The indoor air side passage (32) is provided with an indoor air side filter (27) for removing dust from the air. The indoor air side filter (27) is in the shape of a rectangular plate whose long sides extend in the left-to-right direction, and stands so as to extend laterally across the indoor air side passage (32). The indoor air side filter (27) divides the indoor air side passage (32) into front and rear spaces. The indoor air side passage (32) accommodates an indoor air humidity sensor (96) provided at a portion on the front side (downstream side) of the indoor air side filter (27). The indoor air humidity sensor (96) is attached to the top plate of the casing (11), and checks a relative humidity of the air.

The outdoor air side passage (34) communicates with the outside through a duct connected to the outdoor air intake opening (24). The outdoor air side passage (34) is provided with an outdoor air side filter (28) for removing dust from the air. The outdoor air side filter (28) is in the shape of a rectangular plate whose long sides extend in the left-to-right direction, and stands so as to extend laterally across the outdoor air side passage (34). The outdoor air side filter (28) divides the outdoor air side passage (34) into front and rear spaces. The outdoor air side passage (34) accommodates an outdoor air humidity sensor (97) provided at a portion on the front side (downstream side) of the outdoor air side filter (28). The outdoor air humidity sensor (97) is attached to the bottom plate of the casing (11), and checks a relative humidity of the air.

As described in the above, the space between the upstream side partition plate (71) and the downstream side partition plate (72) in the casing (11) is divided into left and right spaces by the middle partition plate (73). The space on the right side of the middle partition plate (73) constitutes a first heat exchanger chamber (37), and the space on the left side of the middle partition plate (73) constitutes a second heat exchanger chamber (38) (see FIG. 1 and FIG. 3). The width $W_1$ of the first heat exchanger chamber (37) in the left-to-right direction is greater than the width $W_2$ of the second heat exchanger chamber (38) in the left-to-right direction (see FIG. 4). The first heat exchanger chamber (37) constitutes a first main air passage, and the second heat exchanger chamber (38) constitutes a second main air passage.

The first adsorption heat exchanger (51) is accommodated in the first heat exchanger chamber (37). The second adsorption heat exchanger (52) is accommodated in the second heat exchanger chamber (38). Each of the adsorption heat exchanger (51, 52) is formed in a thick rectangular plate or a flat rectangular parallelepiped shape as a whole. The details of the adsorption heat exchangers (51, 52) will be described later.

The adsorption heat exchangers (51, 52) stand in the heat exchanger chambers (37, 38) such that the front side and the rear side thereof are parallel to the upstream side partition plate (71) and the downstream side partition plate (72). In other words, the adsorption heat exchangers (51, 52) are positioned so as to extend laterally across the heat exchanger chambers (37, 38). Each of the heat exchanger chambers (37, 38) is divided into front and rear spaces by the adsorption heat exchangers (51, 52). In the heat exchanger chambers (37, 38), the adsorption heat exchangers (51, 52) are positioned closer to the upstream side partition plate (71) than the center of the heat exchanger chambers (37, 38) in the fore and aft direction. The adsorption heat exchangers (51, 52) are substantially aligned with each other in the left-to-right direction.

Figure 4:
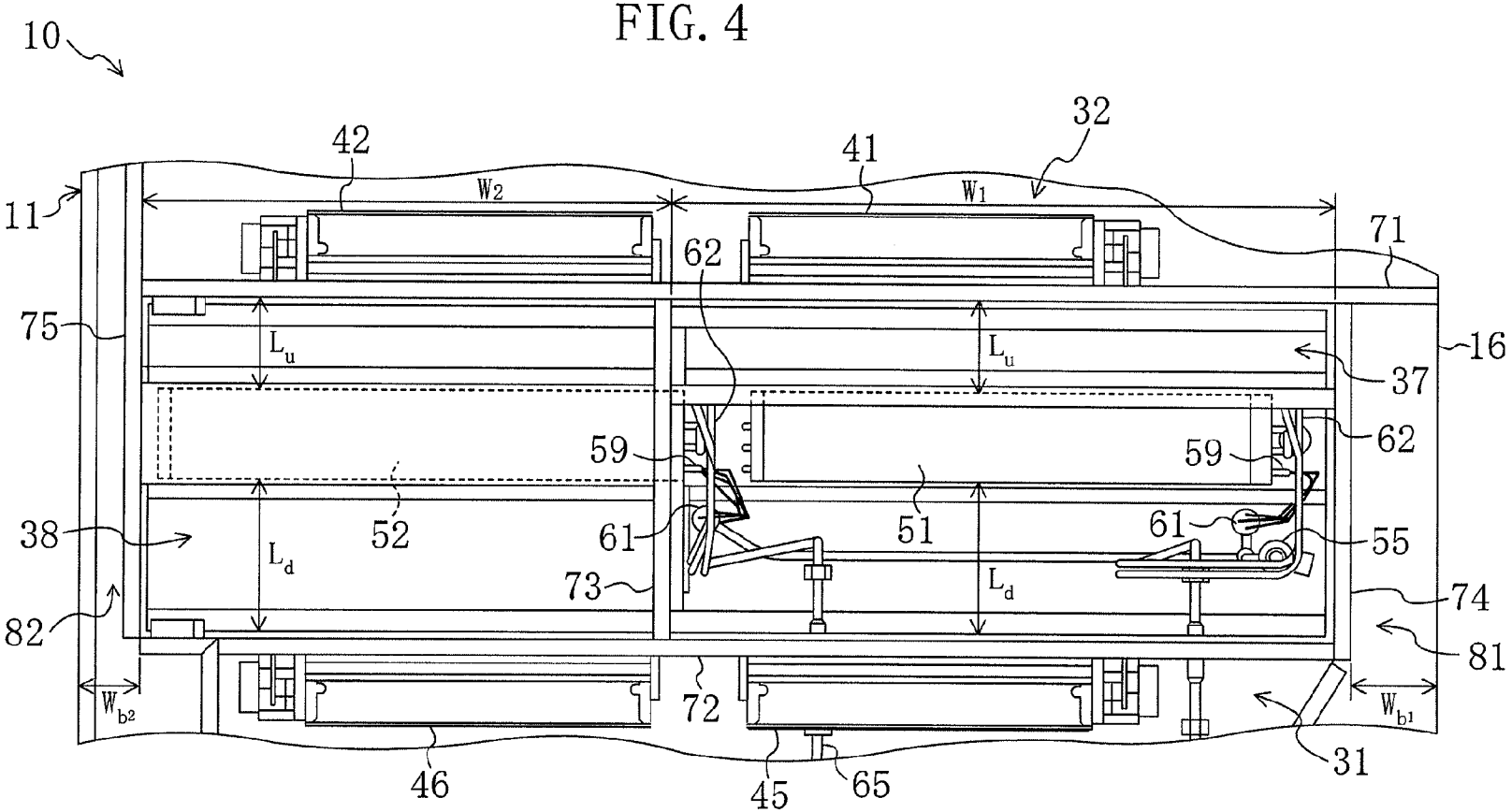
FIG. 4 shows a top view of a main part of the humidity controller without the top plate of the casing.

The length $L_d$ between the front surface of each of the adsorption heat exchangers (51, 52) and the downstream side partition plate (72) is longer than the length $L_u$ between the rear surface of each of the adsorption heat exchangers (51, 52) and the upstream side partition plate (71) (see FIG. 4). In other words, in the heat exchanger chambers (37, 38), the lengths of the spaces on the front side (i.e., downstream side) of the adsorption heat exchangers (51, 52) in the fore and aft direction are greater than the lengths of the spaces on the rear side (i.e., upstream side) of the adsorption heat exchangers (51, 52) in the fore and aft direction.

Each of the adsorption heat exchangers (51, 52) is provided with a liquid side flow divider (61) and a gas side header (62). The entire first adsorption heat exchanger (51), including the liquid side flow divider (61) and the gas side header (62), is accommodated in the first heat exchanger chamber (37). On the other hand, although most part of the second adsorption heat exchanger (52), including all fins (57), is accommodated in the second heat exchanger chamber (38), part of the second adsorption heat exchanger (52) goes through the middle partition plate (73) and projects into the first heat exchanger chamber (37). Specifically, the liquid side flow divider (61) and the gas side header (62) of the second adsorption heat exchanger (52) are located inside the first heat exchanger chamber (37). Further, a U-tube (59) located at the end portion of the second adsorption heat exchanger (52), to which end portion the liquid side flow divider (61) and the gas side header (62) are connected, also projects into the first heat exchanger chamber (37). Moreover, the electrically-operated expansion valve (55) of the refrigerant circuit (50) is accommodated in the first heat exchanger chamber (37).

In the interior space of the casing (11), the space along the front surface of the downstream side partition plate (72) is divided into upper and lower spaces (see FIG. 2, FIG. 3 and FIG. 6). The upper space constitutes a supply side passage (31), and the lower space constitutes an exhaust side passage (33). The supply side passage (31) and the exhaust side passage (33) constitute a blowout side space through which the air having passed through the adsorption heat exchangers (51, 52) flows.

The upstream side partition plate (71) is provided with four openable dampers (41-44) (see FIG. 3 and FIG. 6). Each of the dampers (41-44) is in the shape of an approximately horizontally oriented rectangle. Specifically, a first indoor air side damper (41) and a second indoor air side damper (42) are attached to part of the upstream side partition plate (71) that faces the indoor air side passage (32) (i.e., the upper part of the upstream side partition plate (71)), the first indoor air side damper (41) being on the right side of the middle partition plate (73), and the second indoor air side damper (42) being on the left side of the middle partition plate (73). A first outdoor air side damper (43) and a second outdoor air side damper (44) are attached to part of the upstream side partition plate (71) that faces the outdoor air side passage (34) (i.e., the lower part of the upstream side partition plate (71)), the first outdoor air side damper (43) being on the right side of the middle partition plate (73), and the second outdoor air side damper (44) being on the left side of the middle partition plate (73).

When the first indoor air side damper (41) is opened/closed, the indoor air side passage (32) and the first heat exchanger chamber (37) are connected to/disconnected from each other. When the second indoor air side damper (42) is opened/closed, the indoor air side passage (32) and the second heat exchanger chamber (38) are connected to/disconnected from each other. When the first outdoor air side damper (43) is opened/closed, the outdoor air side passage (34) and the first heat exchanger chamber (37) are connected to/disconnected from each other. When the second outdoor air side damper (44) is opened/closed, the outdoor air side passage (34) and the second heat exchanger chamber (38) are connected to/disconnected from each other.

At the upstream side partition plate (71), the first outdoor air side damper (43) is positioned directly under the first indoor air side damper (41). The first indoor air side damper (41) and the first outdoor air side damper (43) are positioned such that the center of each of the first indoor air side damper (41) and the first outdoor air side damper (43) in the left-to-right direction is closer to the middle partition plate (73) than the center of the first heat exchanger chamber (37) in the left-to-right direction (i.e., positioned closer to the second side panel portion (15) and the second heat exchanger chamber (38)) (see FIG. 3). Specifically, if the casing (11) is viewed in its left-to-right direction, the left end of each of the first indoor air side damper (41) and the first outdoor air side damper (43) is positioned at an approximately the same location where the left end of the first adsorption heat exchanger (51) is located. Further, the first indoor air side damper (41) is opposite to the indoor air intake opening (23), with the indoor air side filter (27) interposed therebetween.

At the upstream side partition plate (71), the second outdoor air side damper (44) is positioned directly under the second indoor air side damper (42). The second indoor air side damper (42) and the second outdoor air side damper (44) are positioned such that the center of each of the second indoor air side damper (42) and the second outdoor air side damper (44) in the left-to-right direction is closer to the middle partition plate (73) than the center of the second heat exchanger chamber (38) in the left-to-right direction (i.e., positioned closer to the first side panel portion (14) and the first heat exchanger chamber (37)) (see FIG. 3). Specifically, if the casing (11) is viewed in its left-to-right direction, the right end of each of the second indoor air side damper (42) and the second outdoor air side damper (44) is positioned at an approximately the same location where the right end of the second adsorption heat exchanger (52) is located. Further, the second outdoor air side damper (44) is opposite to the outdoor air intake opening (24), with the outdoor air side filter (28) interposed therebetween.

The downstream side partition plate (72) is provided with four openable dampers (45-48) (see FIG. 3 and FIG. 6). Each of the dampers (45-48) is in the shape of an approximately horizontally oriented rectangle. Specifically, a first supply side damper (45) and a second supply side damper (46) are attached to part of the downstream side partition plate (72) that faces the supply side passage (31) (i.e., the upper part of the downstream side partition plate (72)), the first supply side damper (45) being on the right side of the middle partition plate (73), and second supply side damper (46) being on the left side of the middle partition plate (73). A first exhaust side damper (47) and a second exhaust side damper (48) are attached to part of the downstream side partition plate (72) that faces the exhaust side passage (33) (i.e., the lower part of the downstream side partition plate (72)), the first exhaust side damper (47) being on the right side of the middle partition plate (73), and the second exhaust side damper (48) being on the left side of the middle partition plate (73).

When the first supply side damper (45) is opened/closed, the supply side passage (31) and the first heat exchanger chamber (37) are connected to/disconnected from each other. When the second supply side damper (46) is opened/closed, the supply side passage (31) and the second heat exchanger chamber (38) are connected to/disconnected from each other. When the first exhaust side damper (47) is opened/closed, the exhaust side passage (33) and the first heat exchanger chamber (37) are connected to/disconnected from each other. When the second exhaust side damper (48) is opened/closed, the exhaust side passage (33) and the second heat exchanger chamber (38) are connected to/disconnected from each other.

At the downstream side partition plate (72), the first exhaust side damper (47) is positioned directly under the first supply side damper (45). The first supply side damper (45) and the first exhaust side damper (47) are positioned such that the center of each of the first supply side damper (45) and the first exhaust side damper (47) in the left-to-right direction is closer to the middle partition plate (73) than the center of the first heat exchanger chamber (37) in the left-to-right direction (i.e., positioned closer to the second side panel portion (15) and the second heat exchanger chamber (38)) (see FIG. 3). Specifically, if the casing (11) is viewed in its left-to-right direction, the left end of each of the first supply side damper (45) and the first exhaust side damper (47) is positioned at an approximately the same location where the left end of the first adsorption heat exchanger (51) is located.

At the downstream side partition plate (72), the second exhaust side damper (48) is positioned directly under the second supply side damper (46). The second exhaust side damper (48) and the second supply side damper (46) are positioned such that the center of each of the second exhaust side damper (48) and the second supply side damper (46) in the left-to-right direction is closer to the middle partition plate (73) than the center of the second heat exchanger chamber (38) in the left-to-right direction (i.e., positioned closer to the first side panel portion (14) and the first heat exchanger chamber (37)) (see FIG. 3). Specifically, if the casing (11) is viewed in its left-to-right direction, the right end of each of the second exhaust side damper (48) and the second supply side damper (46) is positioned at an approximately the same location where the right end of the second adsorption heat exchanger (52) is located.

In the casing (11), the space between the supply side passage (31) and the exhaust side passage (33), and the front panel portion (12) is divided into right and left spaces by a partition plate (77). The space on the right side of the partition plate (77) constitutes a supply fan chamber (36), and the space on the left side of the partition plate (77) constitutes an exhaust fan chamber (35). The partition plate (77) is positioned so as to stand closer to the second side panel portion (15) than the middle partition plate (73) is. Both of the supply fan chamber (36) and the exhaust fan chamber (35) are spaces that extend from the bottom plate to the top plate of the casing (11).

A supply fan (26) is accommodated in the supply fan chamber (36). An exhaust fan (25) is accommodated in the exhaust fan chamber (35). Both of the supply fan (26) and the exhaust fan (25) are a centrifugal type multi-blade fan (so called, sirocco fan).

Specifically, each of these fans (25, 26) has a fan rotor, a fan casing (86), and a fan motor (89). Although not shown, the fan rotor has a cylinder shape whose axial length is shorter than its diameter and which has many blades on its circumferential surface. The fan rotor is accommodated in the fan casing (86). One of the side faces of the fan casing (86) (i.e., side faces which are orthogonal to the axial direction of the fan rotor) has an inlet (87). The fan casing (86) has a portion which outwardly protrudes from the circumferential surface of the fan casing (86), and the end of that portion has an outlet (88). The fan motor (89) is attached to the side face of the fan casing (86) that is opposite to the side face having the inlet (87). The fan motor (89) is connected to the fan rotor to rotate the fan rotor.

When the fan rotor of each of the supply fan (26) and the exhaust fan (25) is rotated by the fan motor (89), air is drawn into the fan casing (86) through the inlet (87), and the air in the fan casing (86) is expelled from the outlet (88).

In the supply fan chamber (36), the supply fan (26) is positioned such that the inlet (87) of the fan casing (86) faces the downstream side partition plate (72). The outlet (88) of the fan casing (86) of the supply fan (26) is attached to the first side panel portion (14) such that the outlet (88) communicates with the supply opening (22).

In the exhaust fan chamber (35), the exhaust fan (25) is positioned such that the inlet (87) of the fan casing (86) faces the downstream side partition plate (72). The outlet (88) of the fan casing (86) of the exhaust fan (25) is attached to the second side panel portion (15) such that the outlet (88) communicates with the exhaust opening (21).

The compressor (53) and the four-way selector valve (54) of the refrigerant circuit (50) are accommodated in the supply fan chamber (36). The compressor (53) and the four-way selector valve (54) are positioned in the supply fan chamber (36) between the supply fan (26) and the partition plate (77).

A connecting pipe (65) extending from the gas side header (62) of each of the adsorption heat exchangers (51, 52) is connected to the four-way selector valve (54). The connecting pipe (65) goes through the downstream side partition plate (72). Specifically, the connecting pipe (65) goes through part of the downstream side partition plate (72) that faces the supply side passage (31) (i.e., the upper part), specifically the part on the right side of the middle partition plate (73) (i.e., the part that faces the first heat exchanger chamber (37)). One of the liquid side flow dividers (61) of the adsorption heat exchangers (51, 52) is connected to one end of the electrically-operated expansion valve (55), and the other liquid side flow divider (61) is connected to the other end of the electrically-operated expansion valve (55).

In the casing (11), the space between the first partition plate (74) and the first side panel portion (14) constitutes a first bypass passage (81) as a first auxiliary air passage (see FIG. 2 and FIG. 3). In the casing (11), the space between the second partition plate (75) and the second side panel portion (15) constitutes a second bypass passage (82) as a second auxiliary air passage (see FIG. 3 and FIG. 5). The first bypass passage (81) and the second bypass passage (82) are spaces that extend from the bottom plate to the top plate of the casing (11). The width $W_{b1}$ of the first bypass passage (81) (i.e., the distance between the first partition plate (74) and the first side panel portion (14)) is greater than the width $W_{b2}$ of the second bypass passage (82) (i.e., the distance between the second partition plate (75) and the second side panel portion (15)) (see FIG. 4).

The starting end of the first bypass passage (81) (i.e., the end of the first bypass passage (81) on the rear panel portion (13)) communicates with only the outdoor air side passage (34) and is blocked from the indoor air side passage (32). The first bypass passage (81) communicates with a downstream side of the outdoor air side filter (28) in the outdoor air side passage (34). The terminating end of the first bypass passage (81) (i.e., the end of the first bypass passage (81) on the front panel portion (12)) is separated from the supply side passage (31), exhaust side passage (33), and supply fan chamber (36) by a partition plate (78). A first bypass damper (83) is provided on the surface of the partition plate (78) that faces the supply fan chamber (36). The first bypass damper (83) is in the shape of an approximately vertically oriented rectangle. When the first bypass damper (83) is opened/closed, the first bypass passage (81) and the supply fan chamber (36) are connected to/disconnected from each other.

The starting end of the second bypass passage (82) (i.e., the end of the second bypass passage (82) on the rear panel portion (13)) communicates with only the indoor air side passage (32) and is blocked from the outdoor air side passage (34). The second bypass passage (82) communicates with a downstream side of the indoor air side filter (27) in the indoor air side passage (32), through a communication opening (76) formed in the second partition plate (75). The terminating end of the second bypass passage (82) (i.e., the end of the second bypass passage (82) on the front panel portion (12)) is separated from the supply side passage (31), the exhaust side passage (33), and the exhaust fan chamber (35) by a partition plate (79). A second bypass damper (84) is provided on the surface of the partition plate (79) that faces the exhaust fan chamber (35). The second bypass damper (84) is in the shape of an approximately vertically oriented rectangle. When the second bypass damper (84) is opened/closed, the second bypass passage (82) and the exhaust fan chamber (35) are connected to/disconnected from each other.

The first bypass passage (81), the second bypass passage (82), the first bypass damper (83), and the second bypass damper (84) are not shown in the right side view and the left side view of FIG. 6.

In the humidity controller (10), the first bypass damper (83), the second bypass damper (84), the first supply side damper (45), the second supply side damper (46), first exhaust side damper (47), and the second exhaust side damper (48) constitute a switching mechanism. That is, in the state where the first supply side damper (45), the second supply side damper (46), the first exhaust side damper (47) and the second exhaust side damper (48) are closed and the first bypass damper (83) and the second bypass damper (84) are opened, the air flowing in the casing (11) does not pass through the first heat exchanger chamber (37) and the second heat exchanger chamber (38), but passes through the first bypass passage (81) or the second bypass passage (82). In the state where the first bypass damper (83) and the second bypass damper (84) are closed and one of the supply side dampers (45, 46) and one of the exhaust side dampers (47, 48) are opened, the air flowing in the casing (11) does not pass through the first bypass passage (81) and the second bypass passage (82), but passes through the first heat exchanger chamber (37) or the second heat exchanger chamber (38).

Part of the first side panel portion (14) of the casing (11) that faces the indoor air side passage (32) and the outdoor air side passage (34) is constituted by an openable panel (17) for filters. Further, part of the first side panel portion (14) that faces the first bypass passage (81) is constituted by a main openable panel (16). The openable panel (17) for filters and the main openable panel (16) are detachable from the casing (11).

A box (90) for electrical components is attached to the right portion of the front panel portion (12) of the casing (11). The box (90) for electrical components is not shown in FIG. 2 and FIG. 6. The box (90) for electrical components is a box having a rectangular parallelepiped shape, and a control board (91) and a power supply board (92) are accommodated in the box (90) for electrical components. The control board (91) and the power supply board (92) are attached to the inner surface of a side plate of the box (90) for electrical components, the side plate being adjacent to the front panel portion (12) (i.e., the rear plate of the box (90) for electrical components). A heat dissipating fin (93) is provided for the inverter of the power supply board (92). The heat dissipating fin (93) protrudes from the rear surface of the power supply board (92), and goes through the rear plate of the box (90) for electrical components and the front panel portion (12) of the casing (11) to project into the supply fan chamber (36) (see FIG. 3 and FIG. 5).

In the casing (11), lead wires connected to the compressor (53), the fans (25, 26), the dampers (41-48), the humidity sensors (96, 97), etc., extend into the box (90) for electrical components. Among the lead wires, lead wires which are connected to a drive motor for the dampers (41-44) attached to the upstream side partition plate (71) and lead wires which are connected to the humidity sensors (96, 97) are provided in the first bypass passage (81) and extend into the box (90) for electrical components.

<Configuration of Refrigerant Circuit>

The refrigerant circuit (50) will be described with reference to FIG. 7.

The refrigerant circuit (50) is a closed circuit that includes the first adsorption heat exchanger (51), the second adsorption heat exchanger (52), the compressor (53), the four-way selector valve (54), and the electrically-operated expansion valve (55). The refrigerant circuit (50) performs a vapor compression refrigeration cycle by circulating the refrigerant with which the refrigerant circuit (50) is filled. The refrigerant circuit (50) constitutes a heat transfer circuit in which a refrigerant as a heat transfer fluid flows.

In the refrigerant circuit (50), the discharge side of the compressor (53) is connected to a first port of the four-way selector valve (54), and the suction side of the compressor (53) is connected to a second port of the four-way selector valve (54). One end of the first adsorption heat exchanger (51)

is connected to a third port of the four-way selector valve (54). The other end of the first adsorption heat exchanger (51) is connected to one end of the second adsorption heat exchanger (52) through the electrically-operated expansion valve (55). The other end of the second adsorption heat exchanger (52) is connected to a fourth port of the four-way selector valve (54).

The four-way selector valve (54) can be switched between the first state (the state shown in FIG. 7A) in which the first port and the third port are connected and the second port and the fourth port are connected, and the second state (the state shown in FIG. 7B) in which the first port and the fourth port are connected and the second port and the third port are connected.

Figure 8:
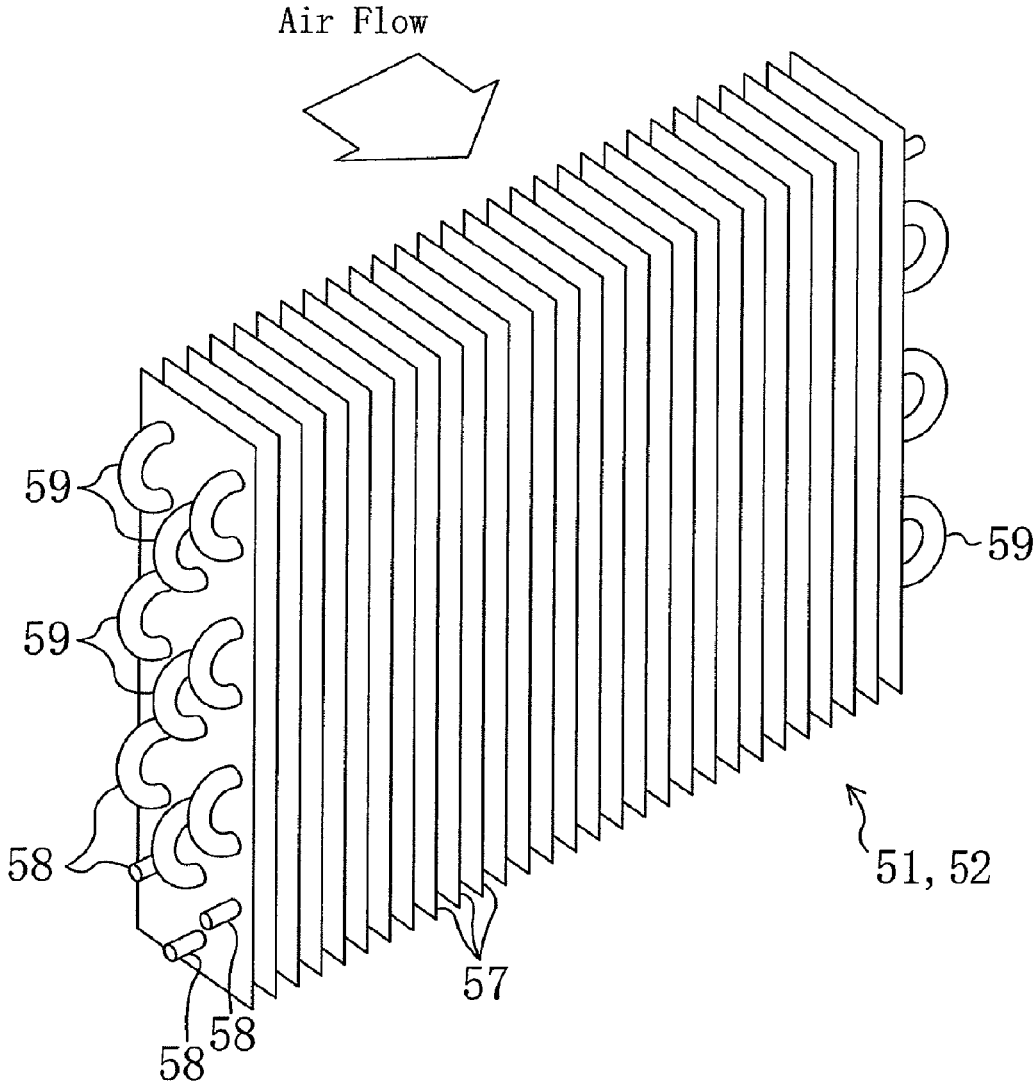
FIG. 8 shows a schematic oblique view of an adsorption heat exchanger.

As shown in FIG. 8, both of the first adsorption heat exchanger (51) and the second adsorption heat exchanger (52) are constituted by a cross fin type fin-and-tube heat exchanger. The adsorption heat exchangers (51, 52) include a heat transfer pipe (58) made of copper and fins (57) made of aluminum. Each of the plurality of fins (57) provided in the adsorption heat exchangers (51, 52) is in the shape of a rectangular plate, and the plurality of fins (57) are arranged at predetermined intervals. The heat transfer pipe (58) meanders along the array direction of the fins (57). In other words, the heat transfer pipe (58) includes, in an alternating manner, straight portions each going through the fins (57), and U-shaped portions (59) each connecting a pair of straight portions adjacent to each other.

In the adsorption heat exchangers (51, 52), an adsorbent is carried on the surface of each fin (57), and air passing through between the fins (57) comes in contact with the adsorbent carried on the fins (57). As the materials for the adsorbent, zeolite, silica gel, activated carbon, and organic polymeric materials with hydrophilic functional groups, etc., which can adsorb vapor in air may be used.

In the humidity controller (10) of the present embodiment, the refrigerant circuit (50) constitutes a heat transfer circuit. In the refrigerant circuit (50), a high-pressured gas refrigerant is supplied as a heat transfer fluid for heating to one of the adsorption heat exchangers (51, 52) that serves as a condenser, and a low-pressured, gas-liquid two-phase refrigerant is supplied as a heat transfer fluid for cooling to the adsorption heat exchanger that serves as an evaporator.

—Operational Behavior—

The humidity controller (10) of the present embodiment selectively performs a dehumidifying ventilation operation, a humidifying ventilation operation, and a simple ventilation operation. The humidity controller (10) during the dehumidifying ventilation operation or the humidifying ventilation operation controls the humidity of the outdoor air (OA) taken therein, and supplies the controlled outdoor air (OA) to a room as supply air (SA), and exhausts the room air (RA) taken therein to the outside as exhaust air (EA). On the other hand, the humidity controller (10) during the simple ventilation operation supplies the outdoor air (OA) taken therein to the room as supply air (SA) without humidity control, and exhausts the room air (RA) taken therein to the outside as exhaust air (EA) without fumidity control.

<Dehumidifying Ventilation Operation>

In the humidity controller (10) during the dehumidifying ventilation operation, a first operation and a second operation, described later, are alternately repeated at predetermined time intervals (e.g., every three minutes). During the dehumidifying ventilation operation, the first bypass damper (83) and the second bypass damper (84) are always closed.

In the humidity controller (10) during the dehumidifying ventilation operation, the outdoor air is taken into the casing (11) as a first air through the outdoor air intake opening (24) by driving the supply fan (26). The room air is taken into the casing (11) as a second air through the indoor air intake opening (23) by driving the exhaust fan (25).

Figure 9:
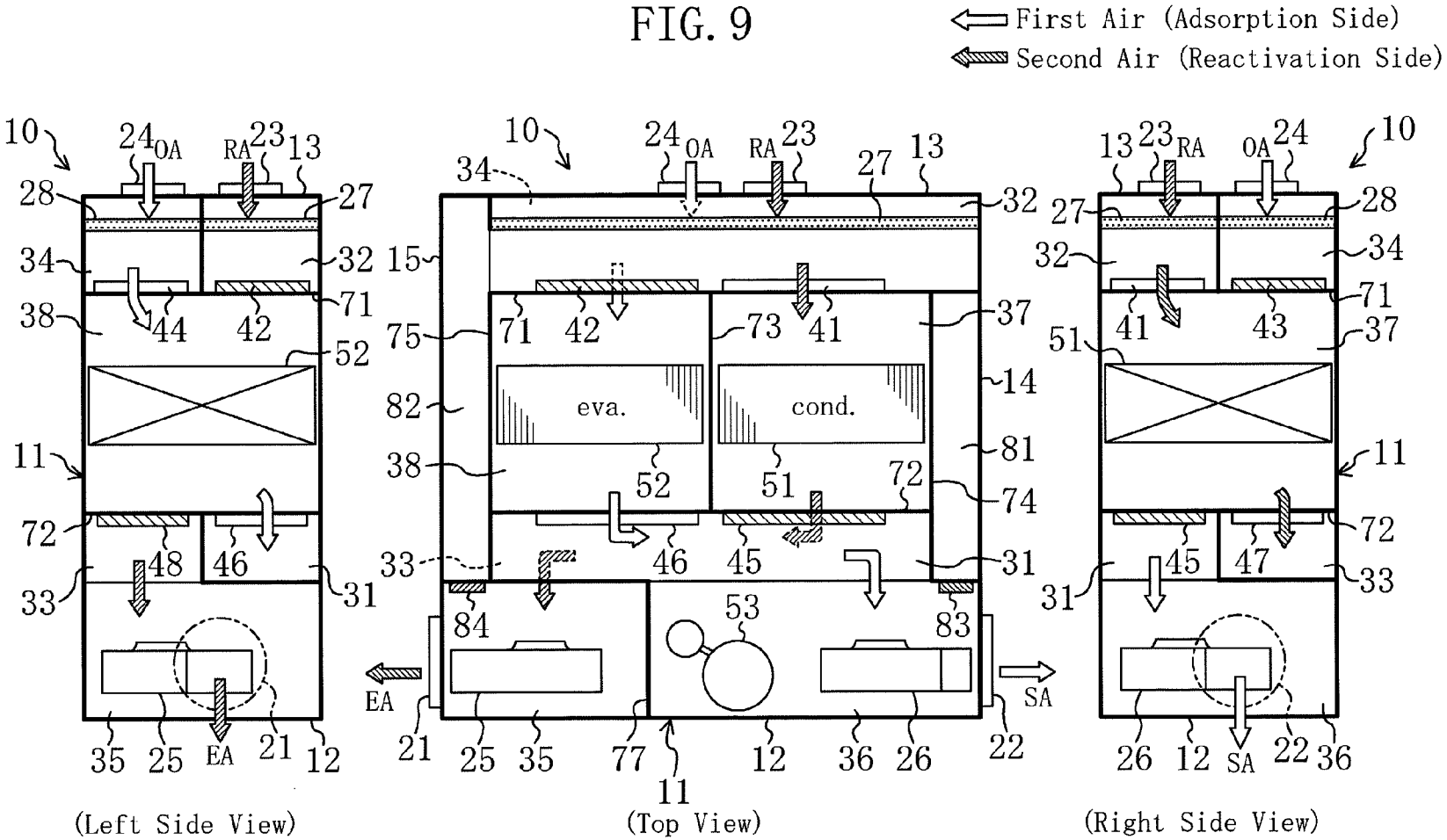
FIG. 9 shows schematic top, right side, and left side views of the humidity controller for illustrating an air flow during the first operation of a dehumidifying ventilation operation.

First, the first operation during the dehumidifying ventilation operation will be described. During the first operation, as shown in FIG. 9, the first indoor air side damper (41), the second outdoor air side damper (44), the second supply side damper (46), and the first exhaust side damper (47) are opened, and the second indoor air side damper (42), the first outdoor air side damper (43), the first supply side damper (45), and the second exhaust side damper (48) are closed.

Figure 7B:
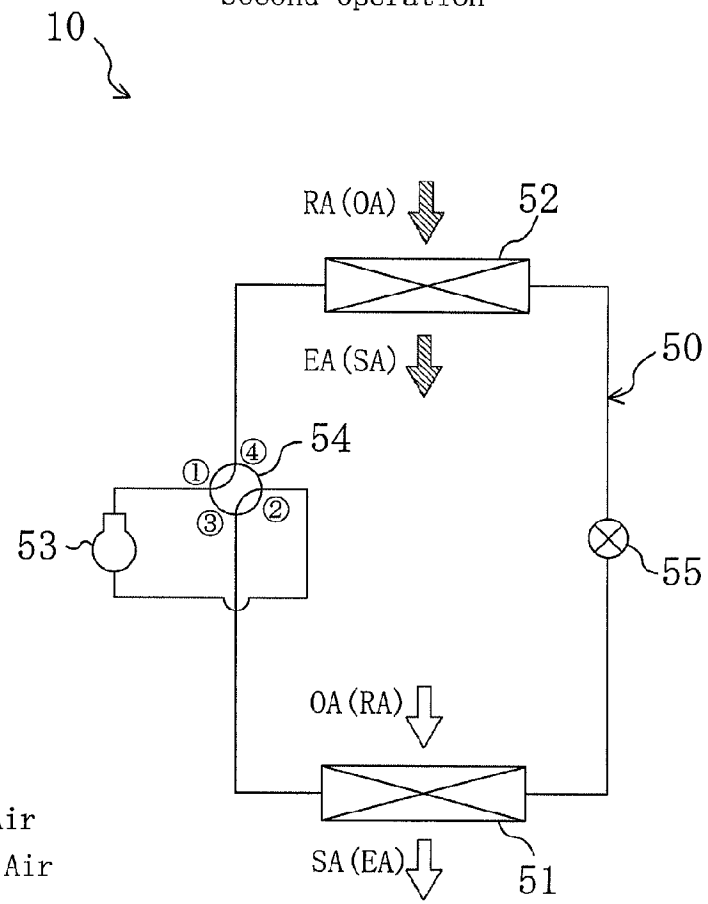
FIG. 7B shows the operation during the second operation.
Figure 7A:
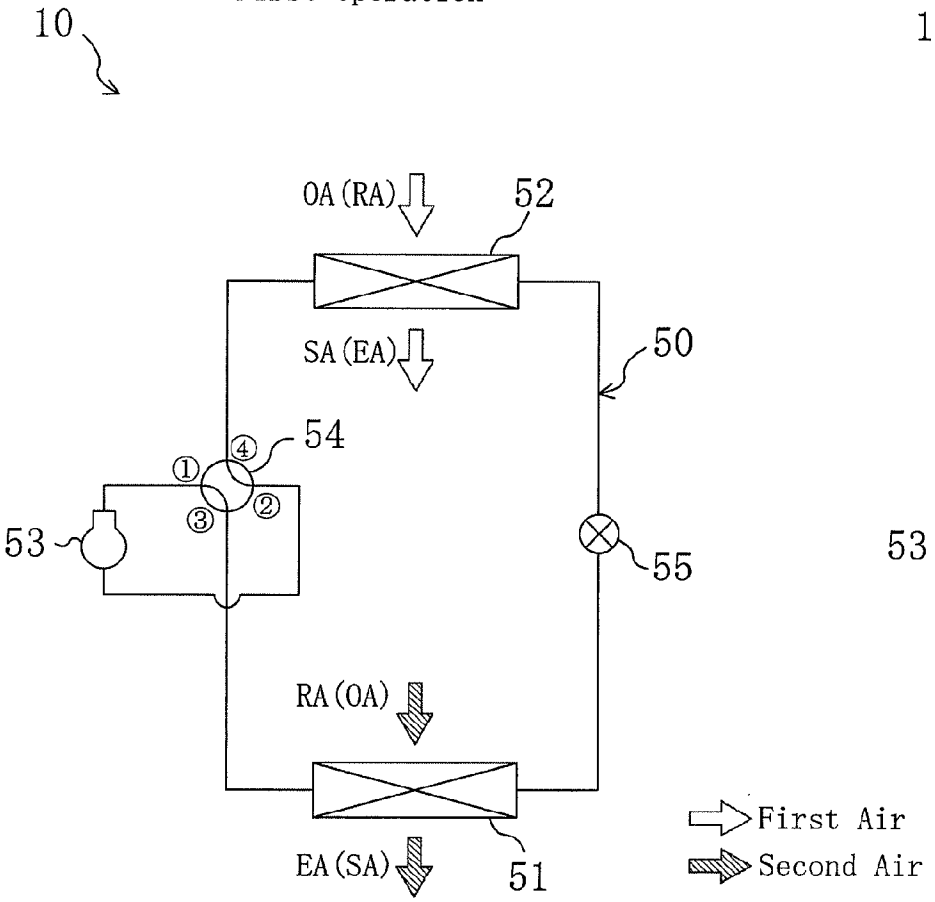
FIG. 7A shows the operation during the first operation.

In the refrigerant circuit (50) during the first operation, the four-way selector valve (54) is set to the first state as shown in FIG. 7A. The refrigerant circuit (50) in this state circulates the refrigerant to perform a refrigeration cycle. In the refrigerant circuit (50) in this state, the refrigerant discharged from the compressor (53) passes through the first adsorption heat exchanger (51), the electrically-operated expansion valve (55), and the second adsorption heat exchanger (52) in this order, and the first adsorption heat exchanger (51) serves as a condenser, and the second adsorption heat exchanger (52) serves as an evaporator.

The first air having flowed into the outdoor air side passage (34) and passed through the outdoor air side filter (28) passes through the second outdoor air side damper (44) to flow into the second heat exchanger chamber (38), and thereafter, passes through the second adsorption heat exchanger (52). In the second adsorption heat exchanger (52), moisture in the first air is adsorbed by the adsorbent, and the heat of adsorption generated during the moisture adsorption is taken by the refrigerant. The first air dehumidified by the second adsorption heat exchanger (52) flows into the supply side passage (31) through the second supply side damper (46), passes through the supply fan chamber (36), and is then supplied into the room through the supply opening (22).

On the other hand, the second air having flowed into the indoor air side passage (32) and passed through the indoor air side filter (27) passes through the first indoor air side damper (41) to flow into the first heat exchanger chamber (37), and thereafter, passes through the first adsorption heat exchanger (51). In the first adsorption heat exchanger (51), moisture is desorbed from the adsorbent heated by the refrigerant, and the desorbed moisture is given to the second air. The second air to which moisture has been given by the first adsorption heat exchanger (51) flows into the exhaust side passage (33) through the first exhaust side damper (47), passes through the exhaust fan chamber (35), and is then exhausted to the outside through the exhaust opening (21).

Figure 10:
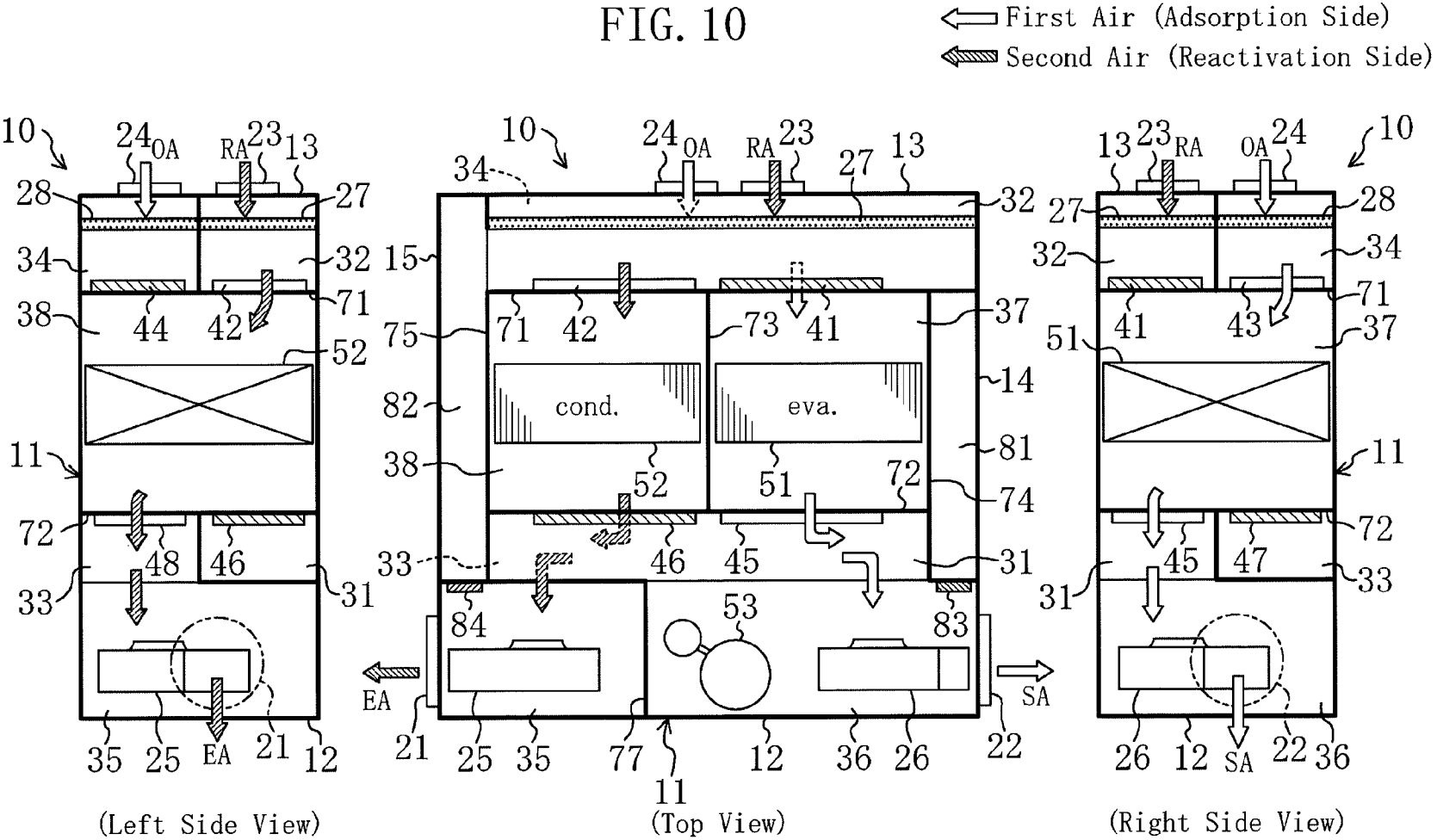
FIG. 10 shows schematic top, right side, and left side views of the humidity controller for illustrating an air flow during the second operation of the dehumidifying ventilation operation.

Next, the second operation during the dehumidifying ventilation operation will be described. During the second operation, as shown in FIG. 10, the second indoor air side damper (42), the first outdoor air side damper (43), the first supply side damper (45), and the second exhaust side damper (48) are opened, and the first indoor air side damper (41), the second outdoor air side damper (44), the second supply side damper (46), and the first exhaust side damper (47) are closed.

In the refrigerant circuit (50) during the second operation, the four-way selector valve (54) is set to the second state as shown in FIG. 7B. The refrigerant circuit (50) in this state circulates the refrigerant to perform a refrigeration cycle. In the refrigerant circuit (50) in this state, the refrigerant discharged from the compressor (53) passes through the second adsorption heat exchanger (52), the electrically-operated expansion valve (55), and the first adsorption heat exchanger (51) in this order, and the first adsorption heat exchanger (51) serves as an evaporator, and the second adsorption heat exchanger (52) serves as a condenser.

The first air having flowed into the outdoor air side passage (34) and passed through the outdoor air side filter (28) passes through the first outdoor air side damper (43) to flow into the first heat exchanger chamber (37), and thereafter, passes through the first adsorption heat exchanger (51). In the first adsorption heat exchanger (51), moisture in the first air is adsorbed by the adsorbent, and the heat of adsorption generated during the moisture adsorption is taken by the refrigerant. The first air dehumidified by the first adsorption heat exchanger (51) flows into the supply side passage (31) through the first supply side damper (45), passes through the supply fan chamber (36), and is then supplied into the room through the supply opening (22).

On the other hand, the second air having flowed into the indoor air side passage (32) and passed through the indoor air side filter (27) passes through the second indoor air side damper (42) to flow into the second heat exchanger chamber (38), and thereafter, passes through the second adsorption heat exchanger (52). In the second adsorption heat exchanger (52), moisture is desorbed from the adsorbent heated by the refrigerant, and the desorbed moisture is given to the second air. The second air to which moisture has been given by the second adsorption heat exchanger (52) flows into the exhaust side passage (33) through the second exhaust side damper (48), passes through the exhaust fan chamber (35), and is then exhausted to the outside through the exhaust opening (21).

<Humidifying Ventilation Operation>

In the humidity controller (10) during the humidifying ventilation operation, a first operation and a second operation, described later, are alternately repeated at predetermined time intervals (e.g., every three minutes). During the humidifying ventilation operation, the first bypass damper (83) and the second bypass damper (84) are always closed.

In the humidity controller (10) during the humidifying ventilation operation, the outdoor air is taken into the casing (11) as a second air through the outdoor air intake opening (24) by driving the supply fan (26). The room air is taken into the casing (11) as a first air through the indoor air intake opening (23) by driving the exhaust fan (25).

Figure 11:
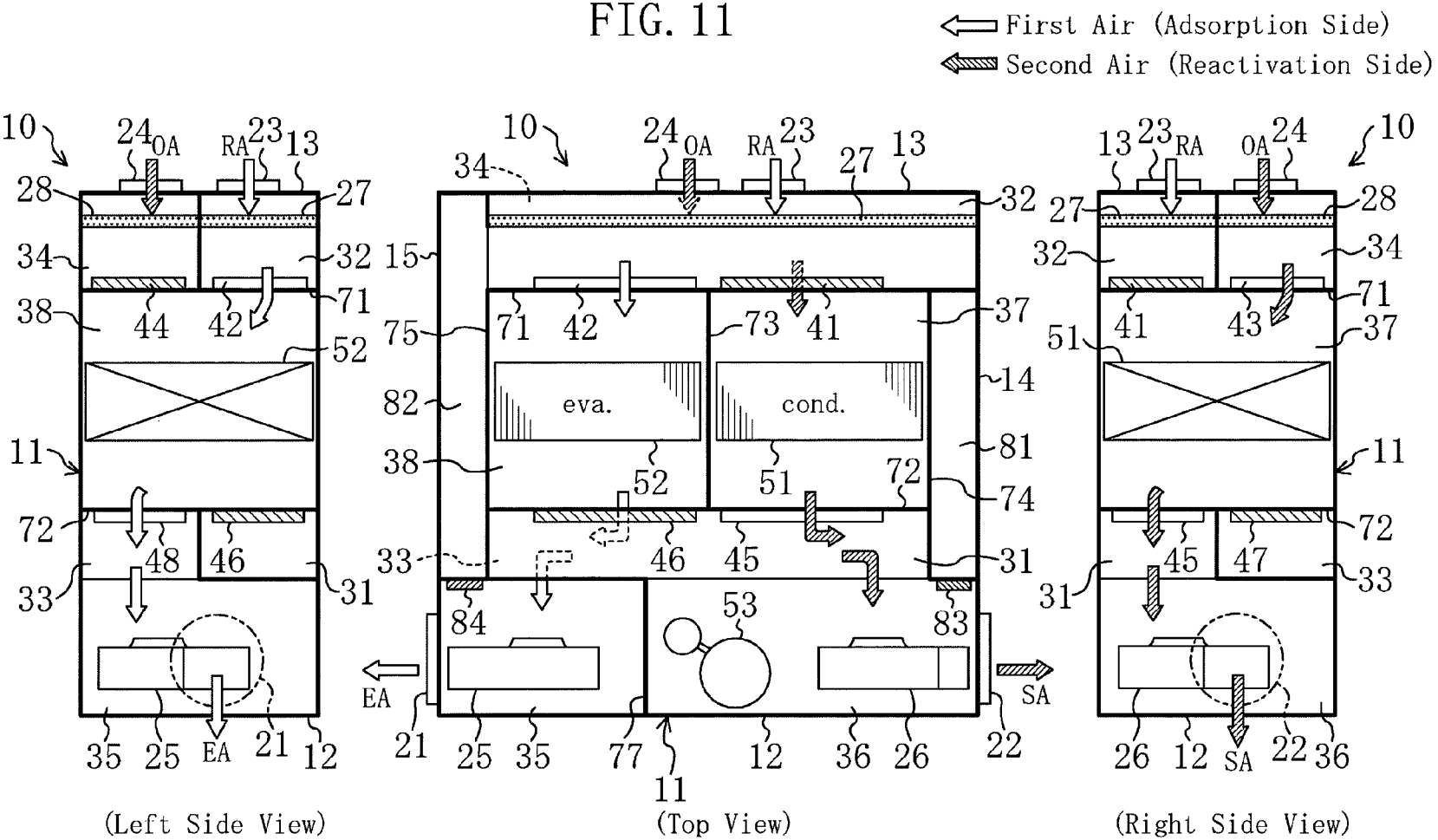
FIG. 11 shows schematic top, right side, and left side views of the humidity controller for illustrating an air flow during the first operation of a humidifying ventilation operation.

First, the first operation during the humidifying ventilation operation will be described. During the first operation, as shown in FIG. 11, the second indoor air side damper (42), the first outdoor air side damper (43), the first supply side damper (45), and the second exhaust side damper (48) are opened, and the first indoor air side damper (41), the second outdoor air side damper (44), the second supply side damper (46), and the first exhaust side damper (47) are closed.

In the refrigerant circuit (50) during the first operation, the four-way selector valve (54) is set to the first state as shown in FIG. 7A. In this refrigerant circuit (50), the first adsorption heat exchanger (51) serves as a condenser, and the second adsorption heat exchanger (52) serves as an evaporator, as in the case of the first operation during the dehumidifying ventilation operation.

The first air having flowed into the indoor air side passage (32) and passed through the indoor air side filter (27) passes through the second indoor air side damper (42) to flow into the second heat exchanger chamber (38), and thereafter, passes through the second adsorption heat exchanger (52). In the second adsorption heat exchanger (52), moisture in the first air is adsorbed by the adsorbent, and the heat of adsorption generated during the moisture adsorption is taken by the refrigerant. The first air whose moisture is taken by the second adsorption heat exchanger (52) flows into the exhaust side passage (33) through the second exhaust side damper (48), passes through the exhaust fan chamber (35), and is then exhausted to the outside through the exhaust opening (21).

On the other hand, the second air having flowed into the outdoor air side passage (34) and passed through the outdoor air side filter (28) passes through the first outdoor air side damper (43) to flow into the first heat exchanger chamber (37), and thereafter, passes through the first adsorption heat exchanger (51). In the first adsorption heat exchanger (51), moisture is desorbed from the adsorbent heated by the refrigerant, and the desorbed moisture is given to the second air. The second air humidified by the first adsorption heat exchanger (51) flows into the supply side passage (31) through the first supply side damper (45), passes through the supply fan chamber (36), and is then supplied to the room through the supply opening (22).

Figure 12:
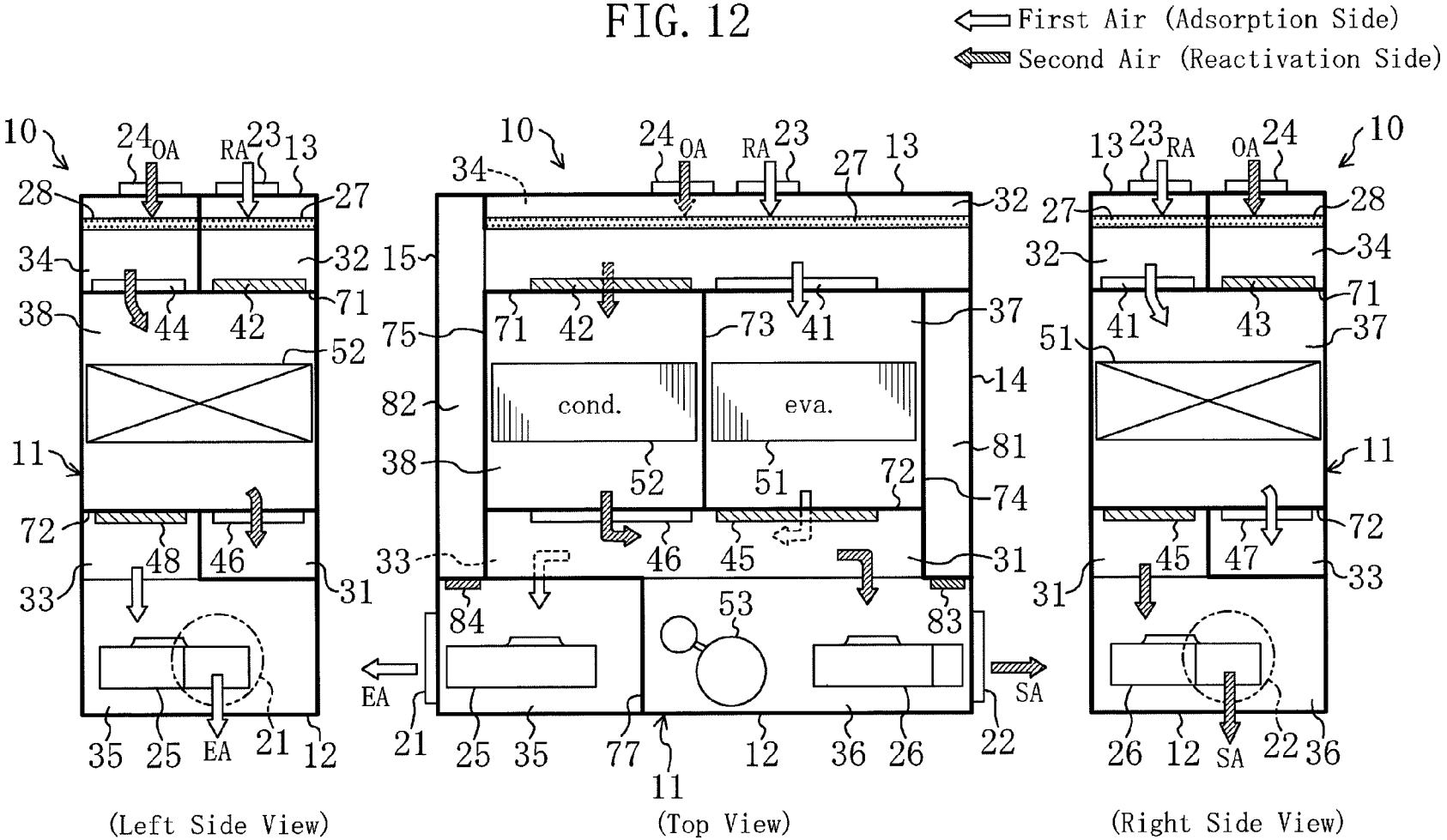
FIG. 12 shows schematic top, right side, and left side views of the humidity controller for illustrating an air flow during the second operation of the humidifying ventilation operation.

Next, the second operation during the humidifying ventilation operation will be described. During the second operation, as shown in FIG. 12, the first indoor air side damper (41), the second outdoor air side damper (44), the second supply side damper (46), and the first exhaust side damper (47) are opened, and the second indoor air side damper (42), the first outdoor air side damper (43), the first supply side damper (45), and the second exhaust side damper (48) are closed.

In the refrigerant circuit (50) during the second operation, the four-way selector valve (54) is set to the second state as shown in FIG. 7B. In this refrigerant circuit (50), the first adsorption heat exchanger (51) serves as an evaporator, and the second adsorption heat exchanger (52) serves as a condenser, as in the case of the second operation during the dehumidifying ventilation operation.

The first air having flowed into the indoor air side passage (32) and passed through the indoor air side filter (27) passes through the first indoor air side damper (41) to flow into the first heat exchanger chamber (37), and thereafter, passes through the first adsorption heat exchanger (51). In the first adsorption heat exchanger (51), moisture in the first air is adsorbed by the adsorbent, and the heat of adsorption generated during the moisture adsorption is taken by the refrigerant. The first air whose moisture is taken by the first adsorption heat exchanger (51) flows into the exhaust side passage (33) through the first exhaust side damper (47), passes through the exhaust fan chamber (35), and is then exhausted to the outside through the exhaust opening (21).

On the other hand, the second air having flowed into the outdoor air side passage (34) and passes through the outdoor air side filter (28) passes through the second outdoor air side damper (44) to flow into the second heat exchanger chamber (38), and thereafter, passes through the second adsorption heat exchanger (52). In the second adsorption heat exchanger (52), moisture is desorbed from the adsorption heated by the refrigerant, and the desorbed moisture is given to the second air. The second air humidified by the second adsorption heat exchanger (52) flows into the supply side passage (31) through the second supply side damper (46), passes through the supply fan chamber (36), and is then supplied to the room through the supply opening (22).

<Simple Ventilation Operation>

Figure 13:
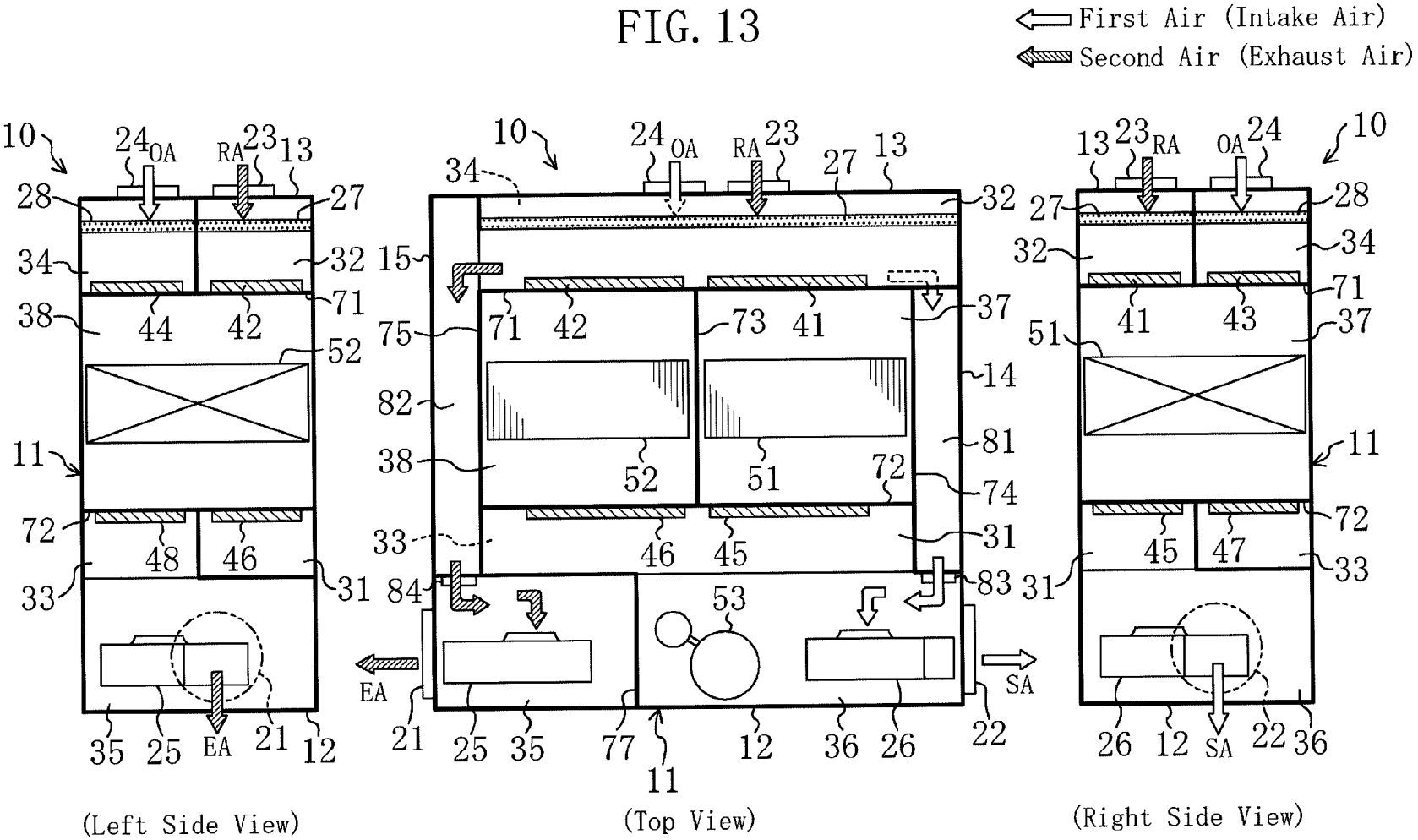
FIG. 13 shows schematic top, right side, and left side views of the humidity controller for illustrating an air flow during a simple ventilation operation.

The operation of the humidity controller (10) during the simple ventilation operation will be described with reference to the FIG. 13. The simple ventilation operation is carried out at a time when outdoor air can be supplied, without humidity control, to the room without reducing comfort of the room (e.g., in moderate seasons such as spring and fall). In other words, this simple ventilation operation is carried out when humidity of the air to be supplied into a room does not have to be controlled, but the room air needs to be ventilated.

In this simple ventilation operation, the first bypass damper (83) and the second bypass damper (84) are opened, and the first indoor air side damper (41), the second indoor air side damper (42), the first outdoor air side damper (43), the second outdoor air side damper (44), the first supply side damper (45), the second supply side damper (46), the first exhaust side damper (47), and the second exhaust side damper (48) are closed. The operation of the compressor (53) of the refrigerant circuit (50) is stopped during the simple ventilation operation. In other words, the compressor (53) does not perform a refrigeration cycle during the simple ventilation operation.

In the humidity controller (10) during the simple ventilation operation, outdoor air is taken into the casing (11) through the outdoor air intake opening (24) by driving the supply fan (26). The outdoor air having flowed into the outdoor air side passage (34) through the outdoor air intake opening (24) passes through the outdoor air side filter (28) to flow into the first bypass passage (81), and passes through the first bypass damper (83) to flow into the supply fan chamber (36). The outdoor air having flowed into the supply fan chamber (36) is drawn into the supply fan (26) to be supplied to the room through the supply opening (22).

In the humidity controller (10) during the simple ventilation operation, room air is taken into the casing (11) through the indoor air intake opening (23) by driving the exhaust fan (25). The room air having flowed into the indoor air side passage (32) through the indoor air intake opening (23) passes through the indoor air side filter (27) to flow into the second bypass passage (82), and passes through the second bypass damper (84) to flow into the exhaust fan chamber (35). The room air having flowed into the exhaust fan chamber (35) is drawn into the exhaust fan (25) to be exhausted to the outside through the exhaust opening (21).

Effects of Embodiment

In the humidity controller (10) according to the present embodiment, bypass passages (81, 82) are provided in the casing (11), and the air which has flowed into the bypass passages (81, 82) is expelled from the casing (11) without passing through the adsorption heat exchangers (51, 52). If the simple ventilation operation is carried out in the situation in which humidity control of the air is not needed, the air taken into the casing (11) flows through the casing (11) without passing through the adsorption heat exchangers (51, 52). In other words, the air flowing in the casing (11) bypasses the adsorption heat exchangers (51, 52) in the humidity controller (10) during the simple ventilation operation in which humidity of air is not controlled.

In the conventional humidity controllers in which air passes through adsorption heat exchangers also during the operation that does not control humidity of the air, odor substances in the air are gradually accumulated in the adsorbent of the adsorption heat exchangers during the operation, whereas according to the humidity controller (10) of the present embodiment, such odor substances are not accumulated in the adsorption heat exchangers (51, 52). Thus, according to the present embodiment, the amount of odor substances accumulated in the adsorption heat exchangers (51, 52) during the simple ventilation operation that does not control humidity of the air can be reduced, and therefore, a reduction in comfort of a room due to a release of the odor substances from the adsorption heat exchangers (51, 52) after restart of humidity control of the air can be avoided.

As described in the above, the humidity controller (10) during the dehumidifying ventilation operation or the humidifying ventilation operation alternately performs an operation in which outdoor air having flowed into the casing (11) through the outdoor air intake opening (24) passes through the first heat exchanger chamber (37) and is then drawn into the supply fan (26), and simultaneously, room air having flowed into the casing (11) through the indoor air intake opening (23) passes through the second heat exchanger chamber (38) and is then drawn into the exhaust fan (25) (see FIG. 10 and FIG. 11), and an operation in which room air having flowed into the casing (11) through the indoor air intake opening (23) passes through the first heat exchanger chamber (37) and is then drawn into the exhaust fan (25), and simultaneously, outdoor air having flowed into the casing (11) through the outdoor air intake opening (24) passes through the second heat exchanger chamber (38) and is then drawn into the supply fan (26) (see FIG. 9 and FIG. 12).

Further, in the humidity controller (10) of the present embodiment, the first indoor air side damper (41), the first outdoor air side damper (43), the first supply side damper (45), and the first exhaust side damper (47), which face the first heat exchanger chamber (37), are positioned at locations close to the middle partition plate (73) (i.e., locations positioned as far as possible from the supply fan (26) and as close as possible to the exhaust fan (25)). In addition, in the humidity controller (10), the second indoor air side damper (42), the second outdoor air side damper (44), the second supply side damper (46), and the second exhaust side damper (48), which face the second heat exchanger chamber (38), are positioned at locations close to the middle partition plate (73) (i.e., locations positioned as far as possible from the exhaust fan (25) and as close as possible to the supply fan (26)).

Further, in the humidity controller (10) of the present embodiment, the outdoor air intake opening (24), through which the outdoor air flowing to the supply fan (26) passes, is open at a location of the rear panel portion (13) that is close to the second heat exchanger chamber (38) (i.e., a location remote from the first heat exchanger chamber (37) near the supply fan (26)). Also, according to this humidity controller (10), the indoor air intake opening (23), through which room air flowing to the exhaust fan (25) passes, is open at a location of the rear panel portion (13) that is close to the first heat exchanger chamber (37) (i.e., a location remote from the second heat exchanger chamber (38) near the exhaust fan (25)).

In other words, in the humidity controller (10) of the present embodiment, the locations of the dampers (41, 43, 45, 47) which face the first heat exchanger chamber (37) are remote from the outdoor air intake opening (24) but close to the supply fan (26) and the supply opening (22), and are close to the indoor air intake opening (23) but remote from the exhaust fan (25) and the exhaust opening (21). Also, in this humidity controller (10), the locations of the dampers (42, 44, 46, 48) which face the second heat exchanger chamber (38) are remote from the indoor air intake opening (23) but close to the exhaust fan (25) and the exhaust opening (21), and are close to the outdoor air intake opening (24) but remote from the supply fan (26) and the supply opening (22).

Thus, in the humidity controller (10) of the present embodiment, a pressure loss of the air flowing from the outdoor air intake opening (24) through the first outdoor air side damper (43), the first heat exchanger chamber (37), and the first supply side damper (45) in this order to the supply fan (26), and a pressure loss of the air flowing from the outdoor air intake opening (24) through the second outdoor air side damper (44), the second heat exchanger chamber (38), and the second supply side damper (46) in this order to the supply fan (26), are equalized. Also, a pressure loss of the air flowing from the indoor air intake opening (23) through the first indoor air side damper (41), the first heat exchanger chamber (37), and the first exhaust side damper (47) in this order to the exhaust fan (25), and a pressure loss of the air flowing from the indoor air intake opening (23) through the second indoor air side damper (42), the second heat exchanger chamber (38), and the second exhaust side damper (48) in this order to the exhaust fan (25), are equalized. Therefore, according to the humidity controller (10) of the present embodiment, the flow rate of air expelled from the supply opening (22) and the exhaust opening (21) can be maintained approximately constant even if the operation is alternately switched between the first operation and the second operation during the dehumidifying ventilation operation and the humidifying ventilation operation.

Further, according to the humidity controller (10) of the present embodiment, the distance between the indoor air intake opening (23) and the second indoor air side damper (42) is greater than the distance between the indoor air intake opening (23) and the first indoor air side damper (41), but the location of the indoor air intake opening (23) is near the center of the casing (11) in the left-to-right direction and is not too remote from the second indoor air side damper (42). Therefore, according to the present embodiment, both of a pressure loss of the air flowing from the indoor air intake opening (23) through the first indoor air side damper (41) to the first heat exchanger chamber (37), and a pressure loss of the air flowing from the indoor air intake opening (23) through the second indoor air side damper (42) to the second heat exchanger chamber (38) can be reduced as much as possible, and the difference between the pressure losses can also be reduced.

Further, according to the humidity controller (10) of the present embodiment, the distance between the outdoor air intake opening (24) and the first outdoor air side damper (43) is greater than the distance between the outdoor air intake opening (24) and the second outdoor air side damper (44), but the location of the outdoor air intake opening (24) is near the center of the casing (11) in the left-to-right direction and is not too remote from the first outdoor air side damper (43). Therefore, according to the present embodiment, both of a pressure loss of the air flowing from the outdoor air intake opening (24) through the first outdoor air side damper (43) to the first heat exchanger chamber (37), and a pressure loss of the air flowing from the outdoor air intake opening (24) through second outdoor air side damper (44) to the second heat exchanger chamber (38) can be reduced as much as possible, and the difference between the pressure losses can also be reduced.

Further, in the humidity controller (10) of the present embodiment, the length $L_d$ between the front surface of the first adsorption heat exchanger (51) or the front surface of the second adsorption heat exchanger (52) and the downstream side partition plate (72) is longer than the length $L_u$ between the rear surface of the first adsorption heat exchanger (51) or the rear surface of the second adsorption heat exchanger (52) and the upstream side partition plate (71) (see FIG. 4). In other words, in each of the heat exchanger chambers (37, 38), the length of the passage on the downstream side of the adsorption heat exchangers (51, 52) is longer than the length of the passage on the upstream side of the adsorption heat exchangers (51, 52). Thus, in each of the heat exchanger chambers (37, 38), the space on the downstream side of the adsorption heat exchangers (51, 52), the space being close to the supply fan (26) and the exhaust fan (25), is relatively wide, and the air flow speed is equalized over the entire part of each of the adsorption heat exchangers (51, 52). Thus, according to the present embodiment, capabilities of the adsorption heat exchangers (51, 52) can be fully exploited.

Further, in the humidity controller (10) of the present embodiment, the supply fan (26) and the exhaust fan (25) are positioned such that the respective inlets (87) face the downstream side partition plate (72). This allows the air which has passed through the dampers (45-48) provided in the downstream side partition plate (72) to smoothly flow to the inlets (87) of the supply fan (26) and the exhaust fan (25). Thus, according to the present embodiment, turbulence of air flowing from the supply side passage (31) to the supply fan (26) or flowing from the exhaust side passage (33) to the exhaust fan (25) can be reduced, and therefore, a pressure loss at a time when the air passes through the casing (11) can be reduced.

Further, in the humidity controller (10) of the present embodiment, the heat dissipating fin (93) for cooling the inverter of the power supply board (92) projects into the supply fan chamber (36), and the air flowing through the supply fan chamber (36) takes heat from the heat dissipating fin (93). Thus, according to the present embodiment, it is not necessary to provide another means that sends the air for cooling the heat dissipating fin (93) to the heat dissipating fin (93), and therefore, the structure of the humidity controller (10) can be simplified.

Modification of Embodiment

In the refrigerant circuit (50) of the present embodiment, a supercritical cycle may be performed in which a high pressure of the refrigeration cycle is set to be a value higher than a critical pressure of the refrigerant. In that case, one of the first adsorption heat exchanger (51) and the second adsorption heat exchanger (52) serves as a gas cooler, and the other serves as an evaporator.

In the humidity controller (10) of the present embodiment, the adsorbent may be heated or cooled by supplying hot water or cold water to the first adsorption heat exchanger (51) and the second adsorption heat exchanger (52). In this case, a pipeline through which the hot water or the cold water is supplied to the adsorption heat exchangers (51, 52) constitutes a heat transfer circuit through which hot water or cold water as a heat transfer fluid flows.

The embodiment described in the above is an essentially preferable example, and is not intended to limit the present invention, its application, or its range of use.

INDUSTRIAL APPLICABILITY

As explained in the above, the present invention is useful as a humidity controller for controlling humidity of room air.

The invention claimed is:

1. A humidity controller comprising:

a heat transfer circuit to which first and second adsorption heat exchangers each carrying an adsorbent are connected and through which a heat transfer fluid flows; and a casing which is formed in a rectangular parallelepiped shape and in which the first and second adsorption heat exchangers are accommodated, wherein the casing is provided with an indoor air intake opening and a supply opening, each communicating with an indoor space, and an outdoor air intake opening and an exhaust opening, each communicating with an indoor space, a first operation in which the adsorbent of the first adsorption heat exchanger is heated and the adsorbent of the second adsorption heat exchanger is cooled, and a second operation in which the adsorbent of the second adsorption heat exchanger is heated and the adsorbent of the first adsorption heat exchanger is cooled are alternately performed, an operation in which an outdoor air from the outdoor air intake opening passes through the first adsorption heat exchanger and flows to the supply opening and in which an indoor air from the indoor air intake opening passes through the second adsorption heat exchanger and flows to the exhaust opening, and an operation in which an outdoor air from the outdoor air intake opening passes through the second adsorption heat exchanger and flows to the supply opening and in which an indoor air from the indoor air intake opening passes through the first adsorption heat exchanger and flows to the exhaust opening, are switched in conjunction with the switching between the first operation and the second operation, an upstream side partition plate facing a rear panel portion which comprises a rear surface of the casing, and an downstream side partition plate facing a front panel portion which comprises a front surface of the casing, are provided in the casing, in the casing, a first main air passage in which the first adsorption heat exchanger is located and a second main air passage in which the second adsorption heat exchanger is located are arranged next to each other in a direction of a width of the casing in a space between the upstream side partition plate and the downstream side partition plate, an indoor air side passage which communicates with the indoor air intake opening, and an outdoor air side passage which communicates with the outdoor air intake opening are arranged next to each other in a direction of a height of the casing in a space between the upstream side partition plate and the rear panel portion, and each of the indoor air side passage and the outdoor air side passage is adjacent to both of the first and second main air passages, a supply fan chamber which is a space extending from a bottom plate to a top plate of the casing and in which a supply fan is accommodated, and an exhaust fan chamber which is a space extending from the bottom plate to the top plate of the casing and in which an exhaust fan is accommodated, are arranged next to each other in the direction of the width of the casing along the front panel portion, a supply side passage which communicates with the supply fan chamber, and an exhaust side passage which communicates with the exhaust fan chamber are arranged next to each other in the direction of the height of the casing along the downstream side partition plate, and each of the supply side passage and the exhaust side passage is adjacent to both of the first and second main air passages, the supply fan chamber is positioned at a location close to the first main air passage, and the exhaust fan chamber is positioned at a location close to the second main air passage, a partition plate which separates the supply fan chamber and the exhaust fan chamber from each other is shifted to the second main air passage in the direction of the width of the casing with respect to a middle partition plate separating the first main air passage and the second main air passage from each other, the downstream side partition plate is provided with a first supply side damper by which the first main air passage and the supply side passage are connected to/disconnected from each other and a first exhaust side damper by which the first main air passage and the exhaust side passage are connected to/disconnected from each other, at locations close to the second main air passage, and is provided with a second supply side damper by which the second main air passage and the supply side passage are connected to/disconnected from each other and a second exhaust side damper by which the second main air passage and the exhaust side passage are connected to/disconnected from each other, at locations close to the first main air passage, the upstream side partition plate is provided with a first indoor air side damper by which the first main air passage and the indoor air side passage are connected to/disconnected from each other and a first outdoor air side damper by which the first main air passage and the outdoor air side passage are connected to/disconnected from each other, at locations close to the second main air passage, and is provided with a second indoor air side damper by which the second main air passage and the indoor air side passage are connected to/disconnected from each other and a second outdoor air side damper by which the second main air passage and the outdoor air side passage are connected to/disconnected from each other, at locations close to the first main air passage, and in the rear panel portion of the casing, the indoor air intake opening is formed at a location where the indoor air intake opening faces the first indoor air side damper and the whole indoor air intake opening is shifted to the first main air passage in the direction of the width of the casing with respect to the middle partition plate, and the outdoor air intake opening is formed at a location where the outdoor air intake opening faces the second outdoor air side damper and part of the outdoor air intake opening is shifted to the first main air passage with respect to the middle partition plate.

* * * * *